US006265648B1

(12) United States Patent
Steinberger

(10) Patent No.: US 6,265,648 B1
(45) Date of Patent: Jul. 24, 2001

(54) STRINGED MUSICAL INSTRUMENT

(76) Inventor: Richard Ned Steinberger, 420 Hill Top Rd., Nobleboro, ME (US) 04555

( * ) Notice: Subject to any disclaimer, the term of this patent is extended or adjusted under 35 U.S.C. 154(b) by 0 days.

(21) Appl. No.: 09/312,882

(22) Filed: May 17, 1999

(51) Int. Cl.[7] ..... G10D 3/00

(52) U.S. Cl. ..... 84/293; 84/267; 84/291

(58) Field of Search ..... 84/293, 267, 291

(56) References Cited

U.S. PATENT DOCUMENTS

| | | | | |
|---|---|---|---|---|
| 14,378 | | 3/1856 | Tilton | 84/299 |
| 294,832 | | 3/1884 | Wichard | 84/285 |
| 454,905 | | 6/1891 | Geiger | 84/299 |
| 466,501 | | 1/1892 | Lyon | 84/294 |
| 478,933 | | 7/1892 | Henning | 84/293 |
| 516,717 | | 3/1894 | Anderberg | 84/293 |
| 519,416 | | 5/1894 | Turner | 84/299 |
| 538,679 | | 5/1895 | Howe | 84/299 |
| 601,071 | | 3/1898 | Borcur | 84/298 |
| 608,279 | | 8/1898 | Benson | 84/293 |
| 621,700 | | 3/1899 | Olson | 84/298 |
| 738,811 | | 9/1903 | Johnson | 84/268 |
| 976,428 | | 11/1910 | Benson et al. | 84/298 |
| 1,010,240 | | 11/1911 | Degulio | 84/294 |
| 1,446,758 | | 2/1923 | McHugh | 84/293 |
| 1,567,359 | | 12/1925 | De Wick | 84/293 |
| 1,611,648 | * | 12/1926 | Lange | 84/293 |
| 1,633,574 | | 6/1927 | Dewey | 84/293 |
| 1,671,942 | | 5/1928 | Strupe | 84/293 |
| 1,707,192 | | 3/1929 | Overton | 84/267 |
| 1,754,263 | | 4/1930 | Claiborne | 84/274 |
| 1,755,019 | | 4/1930 | Parker, Jr. | 84/293 |
| 1,764,679 | | 6/1930 | Gast | 84/295 |
| 1,768,261 | | 6/1930 | Larson | 84/291 |
| 1,818,631 | | 8/1931 | Larson | 84/293 |
| 1,889,408 | | 11/1932 | Larson | 84/293 |
| 1,932,975 | | 10/1933 | Kuhrmeyer | 84/293 |
| 2,335,244 | | 11/1943 | Gugino | 84/293 |
| 2,497,116 | | 2/1950 | Dopyera | 84/293 |
| 2,614,448 | | 10/1952 | Maccaferri | 84/298 |
| 2,737,842 | | 3/1956 | Polfuss | 84/299 |
| 2,793,556 | | 5/1957 | Maccaferri | 84/267 |
| 2,795,988 | | 6/1957 | Maccaferri | 84/293 |
| 3,072,007 | | 1/1963 | Burke | 84/267 |
| 3,143,028 | | 8/1964 | Fender | 84/293 |
| 3,185,011 | | 5/1965 | Anderson | 84/293 |
| 3,196,730 | * | 7/1965 | Daniel | 84/293 |
| 3,204,510 | | 9/1965 | Hopf | 84/291 |
| 3,251,257 | | 5/1966 | Dunker | 84/267 |
| 3,302,507 | | 2/1967 | Fender | 84/267 |
| 3,353,433 | | 11/1967 | Webster | 84/294 |
| 3,418,876 | | 12/1968 | Dopyera | 84/293 |

(List continued on next page.)

FOREIGN PATENT DOCUMENTS

| | | | |
|---|---|---|---|
| 4019376 A1 | | of 0000 | (DE) . |
| 4019376 | * | 1/1991 | (DE) . |

*Primary Examiner*—Shih-Yung Hsieh
(74) *Attorney, Agent, or Firm*—Lerner, David, Littenberg, Krumholz & Mentlik, LLP

(57) ABSTRACT

A stringed musical instrument having an instrument body and an elongated neck along which the strings are stretched. A spring-loaded clamping device is provided by securing the neck to the body while permitting limited pivotal movement of the neck relative to the body. The clamping device includes a spring arranged to provide a biasing force for urging the neck toward a neck seating position on the body, and an adjustment member is moveably mounted on either the neck or the body so as to move in a direction opposing the biasing force of the spring in order to cause the neck to pivot away from the neck seating position, to thereby adjust the angular position of the neck relative to the body to adjust the action of the instrument. An intonation adjustment mechanism is also provided for adjusting the intonation of the instrument, and which advantageously provides for rigidity enhancement by urging the neck against a side of the neck recess to provide a firm, rigid and stable mounting of the neck to the body.

110 Claims, 7 Drawing Sheets

U.S. PATENT DOCUMENTS

| | | | | |
|---|---|---|---|---|
| 3,538,807 | | 11/1970 | Francis | 84/267 |
| 3,550,496 | * | 12/1970 | Fender | 84/293 |
| 3,563,126 | | 2/1971 | Connington | 84/298 |
| 3,858,480 | | 1/1975 | Schneider et al. | 84/1.16 |
| 3,911,778 | | 10/1975 | Martin | 84/267 |
| 4,027,570 | | 6/1977 | Rendell et al. | 84/293 |
| 4,044,644 | | 8/1977 | Mussulman | 84/267 |
| 4,084,476 | | 4/1978 | Rickard | 84/293 |
| 4,126,073 | | 11/1978 | Takabayashi | 84/293 |
| 4,172,404 | | 10/1979 | Dopyera | 84/291 |
| 4,172,405 | | 10/1979 | Kaman | 84/293 |
| 4,228,715 | | 10/1980 | Nourney | 84/1.16 |
| 4,335,641 | | 6/1982 | Höpf | 84/297 R |
| 4,411,186 | | 10/1983 | Faivre | 84/291 |
| 4,432,267 | | 2/1984 | Feller | 84/293 |
| 4,557,174 | | 12/1985 | Gressett, Jr. | 84/293 |
| 4,656,915 | | 4/1987 | Osuga | 84/313 |
| 4,768,415 | | 9/1988 | Gressett et al. | 84/298 |
| 5,018,423 | | 5/1991 | Bunker | 84/293 |
| 5,025,695 | | 6/1991 | Viel | 84/293 |
| 5,421,233 | | 6/1995 | Dunker | 84/293 |
| 5,458,035 | | 10/1995 | Okamura | 84/293 |
| 5,549,027 | | 8/1996 | Steinberger | 84/297 R |
| 5,679,910 | | 10/1997 | Steinberger | 84/291 |
| 5,786,539 | | 7/1998 | Steinberger | 84/293 |

* cited by examiner

STRINGED MUSICAL INSTRUMENT

BACKGROUND OF THE INVENTION

1. Field of the Invention

The present invention relates to stringed musical instruments of the type which include an instrument body, a neck extending therefrom and a plurality of strings attached at one end to the instrument body and at the other end to the neck. More particularly, the present invention is directed to an improved system for mounting the neck of the instrument to the instrument body in a manner so that the position of the strings relative to the neck can be easily, quickly and accurately adjusted. The stringed musical instruments in accordance with the present invention may include guitars, such as acoustic guitars, solid body electric guitars and acoustic electric guitars, but may also include other such stringed musical instruments such as, for example, banjos, mandolins, violins, lutes and/or other similar instruments. Although the principles of the present invention will be described herein in connection with guitars, both acoustic and solid body electric, it should be understood that the principles disclosed are also applicable to other stringed instruments which have an instrument body and an elongated neck along which the strings are stretched.

2. Description of the Prior Art

Stringed musical instruments of the type with which the present invention is concerned typically include an instrument body and an elongated neck along which the strings are stretched. In a guitar, the strings are attached at one end to the neck of the instrument, typically by means of tuning keys or tuning machines provided on the end of the neck remote from the instrument body, often termed the "head" of the guitar. The strings then extend over a "nut" provided at the head end of the neck and extend along the neck toward the body. The other ends of the strings are attached either directly to a bridge which in turn is mounted on the body, or to a tailpiece provided behind the bridge mounted on the body and over which the strings extend. In the play of the instrument, the player moves his fingers up and down the neck, clamping the strings so as to shorten them and create various pitches as the strings are strummed, plucked, or otherwise excited. Typically, the neck of the instrument may be covered with a fingerboard which may carry frets thereon extending across the width of the neck so as to provide a means for anchoring the ends of the shortened strings at definite or desired locations.

In the case of an acoustic instrument, such as an acoustic guitar, the body of the instrument encloses a resonant sound chamber. Strumming, plucking or otherwise exciting the strings causes the strings to vibrate. This vibration in turn causes the bridge over which the strings extend to vibrate as well. In fact, the bridge forms the vibrating end point of the strings for every note that is played. Vibration of the bridge in turn causes the top of the acoustic instrument, known as the soundboard, to vibrate as well, which is turn causes air entrapped in the sound chamber to move to generate the sound heard upon play of the instrument. In the case of electric guitars, the instrument body is usually solid, and pickup devices are utilized to convert the string vibration into sound generated by an amplifier or the like. Some types of electric guitars are acoustic electric guitars which will function as an acoustic guitar but can also be provided with a pickup so that acoustic sound is amplified.

There are three general kinds of neck joints which have been used in stringed musical instruments. "Neck-through" instruments have a neck which extends completely through the instrument, and are almost always permanently glued in place. "Set-neck" instruments have a neck which is also permanently glued in place, with a tenon or dovetail joint where the body meets the neck. These instruments usually have a neck heel just forward of the body which extends down to the back of the body to provide support. Finally, there are "bolt-on" instruments which have an opening in the body where the neck overlaps the body, and where bolts are located which join the neck to the body. Generally, in this type of instrument, the neck joint is made solid so that no movement between the neck and body is possible during use of the instrument. However, the bolts can be loosened so that the neck can be removed from or repositioned in the body.

Acoustic guitars are traditionally set-neck instruments, with a neck heel just forward of the body and extending down to the back of the body. This forward protrusion beneath the neck adjacent the body restricts access to the highest region of the fingerboard during play. Electric guitars are commonly either set-neck instruments or bolt-on instruments. Common bolt-on instruments are economical to the construct and repair. However, the drawbacks of the existing bolt-on designs are that the joint has less side-to-side rigidity than glued necks, and access to the highest region of the front of the fingerboard, near the body, is restricted by the body portion extending under the overlap of the neck.

As the bridge of a stringed musical instrument forms the vibrating end point of the strings for every note that is played, it is therefore extremely influential in determining the sound quality of the instrument. In this regard, it is important that the bridge be securely fastened to the top of the body so that it is fixed in place in order to ensure that energy from the vibrating strings is not needlessly lost. Even with solid body electric guitars, the bridge of the instrument still forms the end point of the strings for every note. A loose fitting bridge or one which is not securely fastened to the top will adversely affect the sound quality of the instrument. Also, anything that affects the position of the bridge—longitudinally, laterally, or the height above the top of the instrument—can affect the sound quality of the instrument. (As convenient nomenclature in describing the present invention, the term "longitudinal" is used to denote a direction generally parallel to the direction that the strings extend, and the term "lateral" is used to denote a direction normal thereto but lying generally in or parallel to the plane of the strings. Similarly, the terms "downward" and "vertical" are used to denote a direction generally normal to the plane of the strings and thus normal to the surface of the top of the guitar.)

The height or spacing of the strings above the fingerboard, often referred to as "action", is generally controlled by the height of the bridge and of the nut, as well as the angularity the top surface of the neck relative to the instrument body. In this regard, tilting of the neck downwardly relative to the guitar body serves to bring the strings closer to the fingerboard, and thus lowers the action. Conversely, tilting of the neck upwardly relative to the body tends to move the strings further away from the fingerboard, thus raising the action. The string/fingerboard spacing is generally a matter of personal preference for the player. However, there is a range or window of desirable action for a player, as no player wants an instrument having an excessively high or an excessively low action. The preference is for the player to be able to maintain the action of the instrument as desired. Thus, a limited degree or amount of adjustability of the string/fingerboard spacing is desirable, not only to accommodate individual preferences, but also to accommodate changes in the guitar's response to the effects of time and environment.

The harmonic length of the individual strings of the instrument is generally determined by the distance between the bridge of the instrument located on the body and the nut which is located on the end of the neck remote from the body. Typically, the nut serves as the base reference point in counting the frets, such that the nut is the "zero" fret. The head of the neck may conveniently be angled away or downwardly relative to the fingerboard so as to ensure that the strings rest against the nut and then extend freely over the fingerboard to the bridge. The intonation or harmonic tone of the strings can be changed or adjusted by changing the distance between the bridge and the nut or other anchor point for the strings.

In many solid body electric guitars, the bridge elements may be adjustable longitudinally toward and away from the nut to adjust the intonation of the individual strings. Also, the overall bridge of the instrument may be mounted so as to be moveable longitudinally. In addition, in some instances, the bridge saddles or string support elements may be moved vertically as well to adjust the height or action of the strings. Although adjustable bridges have commonly been employed with electric guitars with satisfactory results, subtle improvements in tone and/or new piezo bridge pickup technologies make the use of a fixed, non-adjustable bridge desirable.

For acoustic guitars, it generally is undesirable to provide an adjustable bridge. Since sound in acoustic guitars is accomplished by driving the soundboard as a result of string vibration, it is desirable to keep the weight of the bridge as small as possible. Making a bridge adjustable would tend to increase the weight, and would change the overall sound quality and would impact on the soundboard serving as an effective sound diaphragm in an acoustic guitar. Moreover, the presence of moving parts in the bridge can lead to some instability which can degrade the sound quality of the instrument.

Accordingly, for these types of reasons as well as the issue of tone quality, most acoustic guitars utilize a fixed, non-adjustable bridge. Moreover, the action (as well as the intonation) of most acoustic stringed musical instruments is set at the factory, and is not readily changeable in the field. This is a significant deficiency of these types of instruments since different players prefer different settings for the action. Furthermore, the wood of which most guitars and the like are constructed is an unstable material, and the action of the instrument tends to vary with atmospheric conditions. For instance, an increase in the humidity tends to cause the top of the instrument to rise due to swelling of the wood, which in turn increases the action of the instrument. Moreover, the top of an acoustic guitar moves up and down seasonally and as it ages.

Consequently, acoustic instruments without action adjustment present a constant problem in that they need to be returned on a periodic basis to the manufacturer or to the place that they were purchased for adjustment, or in some instances, they need to be returned to the manufacturers by the dealer/retail establishment even before any sale. Although the intonation of an acoustic stringed musical instrument is not as sensitive to variations in atmospheric conditions or over time, any changes in intonation which may be desired also typically require return of the instrument to allow relocation of the position of the bridge on the soundboard. It will be appreciated that any return of the instrument, either before it is ever sold by the dealer or when it is returned to the dealer for periodic adjustment, costs time and money.

Therefore, a strong need remains for a system for mounting the neck of a stringed musical instrument to the instrument body in a manner so as to provide for easy and rapid adjustment of the position of the neck relative to the body, and in particular, adjustment of the action of the instrument. Providing an adjustable neck can provide significant cost savings. For instance, at the time of purchase, dealers will be able to maintain optimal action for the instrument irrespective of the seasonal climate, and will be able to adjust the action to meet specific customer preferences. At the factory, providing an adjustable neck joint or system for mounting of the neck to the guitar would permit acoustic guitars to be assembled from complete, pre-finished body and neck subassemblies, and then quickly adjusted for ideal intonation and/or action. In this regard, one of the most significant cause of problems and returns of musical instruments concerns the action height, which heretofore could not be easily, rapidly and accurately adjusted. Further, providing an adjustable neck permits one to maintain the height of the bridge on the acoustic instrument without change, which has an important effect on the tonal response for the instrument. Further still, an adjustable neck would be able to accommodate and provide action adjustment to accommodate seasonal and age changes of the instrument over time. Furthermore, the action could be tweaked just before a performance or even between songs if desired. Moreover, with acoustic electric instruments, which may be used either as an acoustic instrument or an electric instrument, providing an easily and quickly adjustable neck would enable a musician to shift in the field from an acoustically powerful high action to a low electric action in a short time. This would allow the acoustic electric instrument to be adjusted optimally for either acoustic play or electric play, providing a level of versatility that guitars have never known.

There are numerous examples in the prior art of devices and systems for adjusting the action of a stringed musical instrument. For instance, U.S. Pat. Nos. 1,889,408; 2,793,556; and 3,302,507 all show examples of stringed musical instruments having mechanisms or devices for varying the inclination of the neck to provide adjustable action, such as by means of a tensioning rod, an adjustable tailpiece and/or the use of shims. U.S. Pat. Nos. 1,707,192, 1,755,019 and 4,172,404 each show stringed musical instruments in which the neck of the instrument is designed to be tiltable at the forward end of the body and in which some type of spring or resilient means is provided for urging the neck toward a particular position. Specifically, in U.S. Pat. No. 1,755,019, a U-shaped spring member constructed of resilient metal is provided for attaching the neck to the body. In U.S. Pat. No. 1,707,192, the neck is joined to the instrument body by means of a hinge pin and a resilient material such as rubber or cork is provided between the neck and the body. In U.S. Pat. No. 4,172,404, the neck is also joined to the instrument body by means of a hinge pin and is urged to pivot thereabout by a coil spring. The orientation of the neck relative to the body is adjustable by means of a slideable plate member having a cam surface engaged by a cam follower provided on an extension of the neck which is urged into engagement with the cam plate by means of the coil spring. Although the devices of such prior art patents are adapted to permit variation in the neck inclination, the constructions as described therein have not proved to be commercially practical, for a variety of reasons, including excessive expense and complexity, insufficient strength or stability, the requirement for excessive clearances, unsightliness, and the inability to adjust intonation as well as the inclination of the neck.

Still other examples of stringed musical instruments having mechanisms or devices for permitting adjustment of the inclination of the neck include U.S. Pat. Nos. 3,196,730; 3,204,510 and 3,550,496, all of which show bolt-on necks. In both U.S. Pat. Nos. 3,196,730 and 3,500,496, the necks are removably secured to the body for means of mounting screws. In order to adjust the orientation of the neck, the mounting screws need to first be loosened to allow pivoting of the neck relative to the body. Adjustment screws must then be either tightened or loosened to thereby set the orientation of the neck in the desired position. The mounting screws then must be retightened to secure the neck to the instrument body. While such arrangements do provide for the desired adjustability of the neck to adjust the action of the instrument, the actual accomplishment of such action adjustment involves a number of operations, involving the loosening of the mounting screws, adjusting the neck and retightening of the mounting screws. Such operations can be both time consuming and can require a certain degree of skill in retightening of components. Still further, there is an inherent amount of play with such arrangements which can lead to degradation of the sound quality of the instrument.

Still other patents which show additional arrangements to provide for adjustment of the neck mounted on the body include U.S. Pat. Nos. 5,679,910 and 5,786,539. Both of these patents show arrangements for providing both action adjustment and intonation adjustment. In particular, intonation changes are accomplished by adjusting the distance that neck projects from the instrument so that there thus is a global change in the intonation or harmonic length of all of the strings of the instrument. Action adjustment of the instrument is accomplished by tilting of the neck of the guitar with respect to the guitar body. Moreover, U.S. Pat. No. 5,786,539 discloses particular mounting arrangements to provide a relatively rigid, solid joint in all directions, including side-to-side stability, by applying pressure simultaneously against fixed horizontal and vertical surfaces. However, even in these arrangements, adjustment of the position of the neck relative to the body is relatively inconvenient and time consuming. Many musicians prefer different action heights for different musical styles, and hence desire a means for changing of the action of their instruments quickly and conveniently, and in some instances even during a performance.

The present invention provides for further improvements in providing for action adjustment, and in preferred embodiments, intonation adjustment and rigid, stable mounting arrangements as well. In particular, the present invention is directed to providing for an easy, rapid adjustment of the action of instrument while accomplishing same in an efficient, economical manner without providing inherent instability for the instrument.

SUMMARY OF THE INVENTION

In accordance with one aspect of the present invention, there is provided a stringed musical instrument which comprises an instrument body, a neck extending outwardly from the instrument body and arranged to pivot relative to the body, a plurality of strings attached at one end to the body and at the other end to the neck, and a spring-loaded clamping device for securing the neck to the body while permitting limited pivotal movement of the neck relative to the body. The clamping device includes a spring arranged to provide a biasing force for urging the neck toward a neck seating position on the body, and an adjustment member is moveably mounted on one of the neck and the body and engages the other of the neck and the body. The adjustment member is mounted so as to move in a direction opposing the biasing force of the spring of the clamping device in order to cause the neck to pivot away from the neck seating position to adjust the angular position of the neck relative to the body to thereby adjust the action of the instrument. In a preferred embodiment, the spring member comprises a plurality of belleville washers, and the clamping device comprises a bolt member having a shaft and a head, the shaft being arranged to extend through either the neck or the body and engaging the other of the neck and body, with the belleville washers being arranged about the shaft of the bolt member and positioned between the head of the bolt member and the neck or body through which the bolt member extends.

In accordance with another aspect of the present invention, the instrument body of the stringed musical instrument has a recess for receiving one end of the neck. A mounting device which engages the neck and the body is provided which is operative so as to permit the neck to move between a first position in which the bottom surface of the neck engages the bottom surface of the recess in the body, and a second position in which at least a portion of the bottom surface of the neck is disposed away from the recess. A spring member is operatively arranged to provide a biasing force acting on the neck and the body to urge the neck towards the first position, and an adjustment member is mounted on one of the neck and body and engaging the other of the neck and body. The adjustment member is arranged to act against the biasing force of the spring and is moveable so as to adjust the position of the neck between the first and second positions.

Again, in a preferred embodiment, the mounting device comprises a bolt member and the spring member comprises a belleville washer or washers. Also, the neck is preferably mounted so as to pivot about a pivot axis extending traverse to the longitudinal extent of the neck, and the adjustment member is mounted at a predetermined distance from the pivot axis to cause the neck to pivot about the pivot axis to adjust the angular position of the bottom surface of the neck relative to the bottom surface of recess. Still more preferably, the adjustment member comprises a threaded member threadably mounted in the neck and having an end extending through the bottom surface of the neck to contact a pressure plate provided in the recess of the body. Preferably, the fingerboard of the neck includes an opening to provide access through the fingerboard to rotate the adjustment member. In this manner, adjustment of the action of the instrument is easily and quickly accomplished by simply rotating the adjustment member with an appropriate tool or instrument which may be inserted through the opening in the fingerboard. This could be accomplished either immediately before a performance, or even on stage between songs. And yet a secure, stable mounting arrangement is provided for securing the neck to the body as a result of the spring loading. Conveniently, the amount of force provided by the spring may be on the order of 100 pounds or greater so that the neck is mounted to the body in a substantial and stable manner. With the present invention, any inherent "plays" or looseness in the mounting arrangement for the neck (as a result of providing for movement of the neck relative to the body) is eliminated by the spring member which serves to overcome the normal forces which might be exerted on the instrument during play by the musician or due to the effects of time and environment.

In accordance with a still further embodiment of the present invention, the mounting device is also operative to urge the neck against one side surface of the recess, such as through the use of an angled surface on one or more components provided in the body and/or neck which, upon application of a suitable force or pressure, causes the neck to be urged against a side surface of the recess in the body. This type of arrangement for providing a stable, solid mounting of the neck to the body is disclosed and taught in U.S. Pat. No. 5,786,539, which patent is hereby incorporated by reference. In a preferred embodiment, complimentary angled surfaces which mate against one another are provided on components provided in both the body and neck to assist in urging the neck into firm contact with a side surface in the recess of the body.

Still further in accordance with another aspect of the present invention, the mounting device includes an intonation adjustment mechanism for adjusting the distance between the bridge on the body and the nut on the neck. For instance, the intonation adjustment mechanism may include one or more of the devices as disclosed and taught in the aforementioned U.S. Pat. No. 5,786,539, and may include a moveable member having a bearing portion mounted on the body and moveable in a direction substantially parallel to the direction that the strings extend, and a bearing member provided in the neck and engagable by the bearing portion of the moveable member. Movement of the moveable member to adjust its position relative to the body thus serves to adjust the position of the neck relative to the body to thereby adjust the intonation of instrument. In a preferred embodiment, the moveable member comprises a push rod provided in a housing. In accordance with a still further preferred embodiment, the push rod includes an angled surface, and the bearing member in the neck includes a complimentary angled surface so that adjustment of the intonation also serves to urge the neck against a side surface of the recess provided in the body to provide a rigid, secure and stable mounting arrangement.

These and other features and characteristics of the present invention will be apparent from the following detailed description of preferred embodiments which should be read in light of the accompanying drawings in which corresponding reference numbers refer to corresponding parts throughout the several views.

DETAILED DESCRIPTION OF THE PREFERRED EMBODIMENTS

Figure 1:
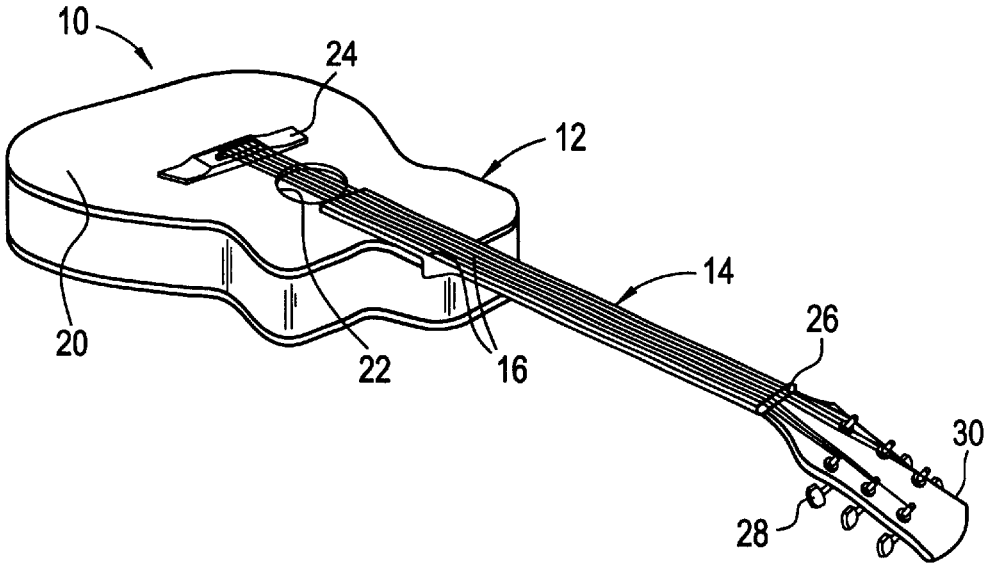
FIG. 1 is a perspective view of an acoustic guitar in accordance with one embodiment of the present invention.
Figure 2:
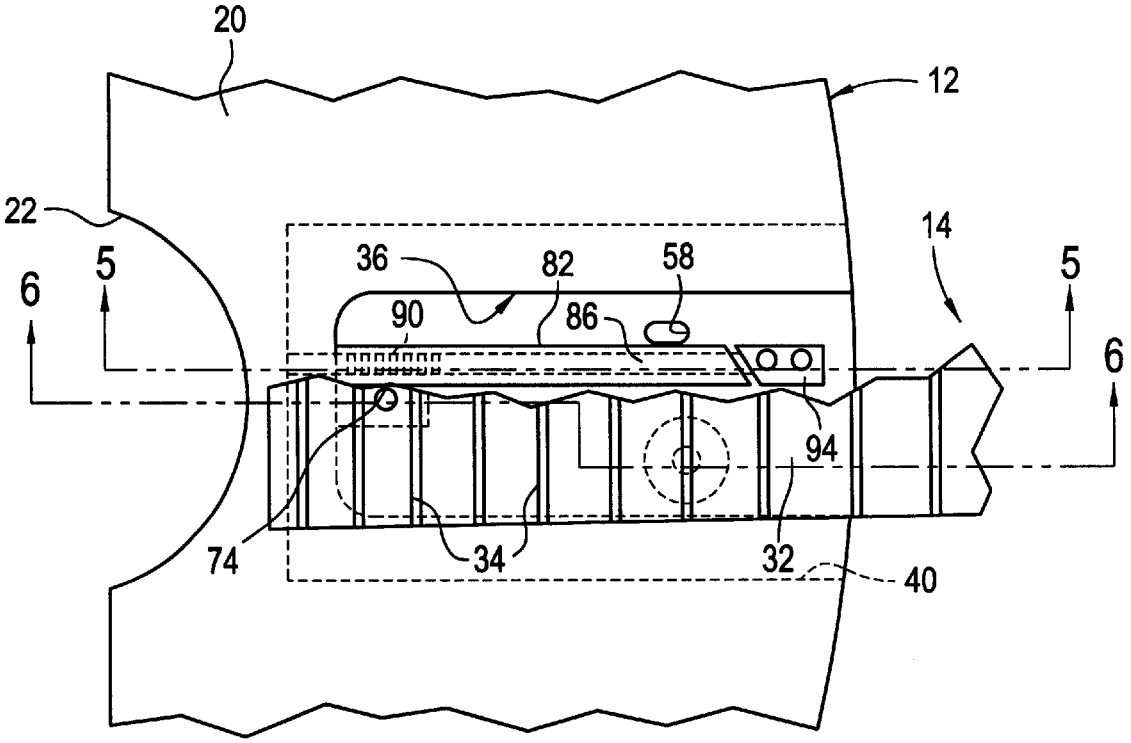
FIG. 2 is a partial plan view, partially broken away for clarity, of a portion of the acoustic guitar shown in FIG. 1 which illustrates one embodiment of a neck joint in accordance with the present invention.

Referring now to the drawings wherein like reference characters represent like elements, FIG. 1 shows a stringed musical instrument 10 in accordance with the present invention, having an instrument body 12, an elongated neck 14 secured to the body 12 and extending therefrom, and a plurality of strings 16 secured or attached at one end to the body 12 of the instrument 10 and at the other end to the neck 14. In the embodiment shown in FIG. 1, the stringed musical instrument in accordance with the present invention is an acoustic guitar 10 in which the body 12 includes a hollow sound chamber 18 covered by a top soundboard 20 having a sound hole 22 therein. On the instrument body 12, the ends of the strings 16 are secured to a bridge element 24, which in turn is fixedly mounted on the top soundboard 20 of the guitar body 12. The strings 16 are stretched along the top of the neck 14 and pass over a nut 26 provided near the end of the neck 14. From there, the strings 16 are attached to tuning keys or tuning machines 28 provided on the head 30 of the neck 14. Typically, the head 30 is angled downwardly in order to ensure that the strings 16 are in contact with the nut 26. Along the top of the neck 14 and beneath the strings 16, there is provided a fingerboard 32 having a plurality frets 34 which extend across the width of the neck 14. The fingerboard 32 is typically glued or otherwise secured to the neck 14. The frets 34 serve to provide a means for anchoring the ends of the strings 16 at definite locations during play of instrument 10 to create different pitches or sounds for the strings 16 when they are strummed, plucked or otherwise excited.

As discussed hereinbefore, the term "action" is a characteristic of the stringed musical instrument 10 relating to the spacing between the strings 16 and the fingerboard 32. Typically, the desired height of the strings 16 above the frets 34 is on the order of approximately 1/16" for electric guitars, and approximately 1/8" for acoustic guitars, although slightly greater or smaller distances are also typical depending upon the musician or other person who plays the instrument 10. The "action" or height of the strings 16 above the fingerboard 32 is generally determined by the height of the bridge 24 provided on the guitar body 12, the height of the nut 26 and the angular position of the neck 14 relative to the body 12. In order to adjust the action of the instrument 10 where the bridge 24 is fixed to the soundboard 20 and is not adjustable (which is normally the case for acoustic guitars for the reasons noted hereinabove), the neck 14 is adapted to tilt or pivot relative to the body 12 to adjust the angle of orientation of the neck 14 relative to the body 12. For instance, it will be appreciated that pivoting of the head end of the neck 14 downwardly in FIG. 1 will serve to lower the action of the strings 16 as they are moved closer to the fingerboard 32. Conversely, raising of the head end of the neck 14 relative to the body as shown in FIG. 1 will serve to raise the action or height of the strings 16 above the fingerboard 32. While the particular spacing of the strings above the fingerboard 32 is a matter personal preference to the player or musician, there is a range or window for the proper height of the strings 16 relative to the fingerboard 32. In other words, no musician wants too excessively high action or too excessively low action for the instrument 10.

Of course, it will also be appreciated by those familiar with stringed musical instruments that the strings 16 could be secured to a tailpiece mounted on the guitar body 12 behind the bridge 24. Again, however, the height of the strings relative to the fingerboard 32 is still determined by the height of the bridge element 24 on the top soundboard 20, the height of the nut 26 and the angle that the neck 14 makes with the instrument 10. Also, the soundboard or top cover 20 of the acoustic guitar 10 serves as a sound diaphragm for the instrument, and may either be flat or arched. The neck mounting device in accordance with the present invention may be utilized with either flat top acoustic guitars or arched-top acoustic guitars, as well as with solid body electric guitars and acoustic electric guitars, and also with other stringed musical instruments of the type having a body and a neck extending therefrom along which the strings of the instrument are stretched.

Figure 3:
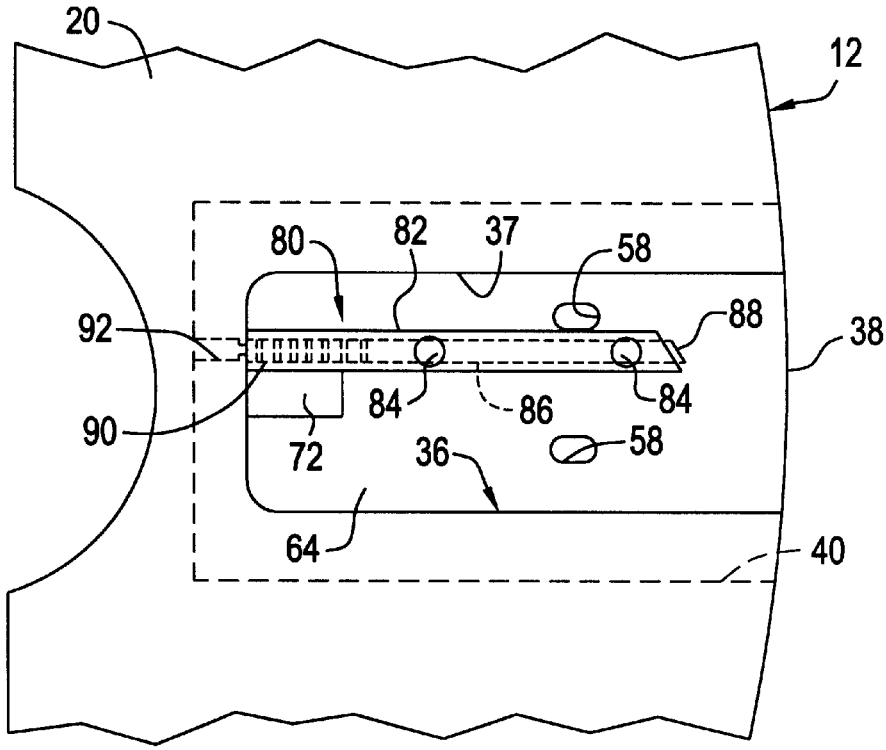
FIG. 3 is a partial plan view of a portion of the body of the guitar shown in FIG. 1 but with the neck removed for clarity, and illustrating an intonation adjustment mechanism in accordance with one aspect of the present invention.
Figure 4:
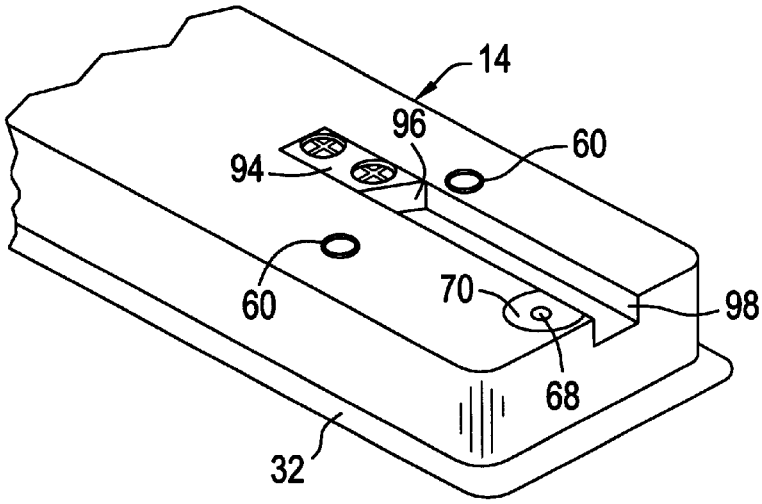
FIG. 4 is a partial perspective view of the bottom of one end of a guitar neck which is to be secured in the recess of the body shown in FIG. 3.
Figure 5:
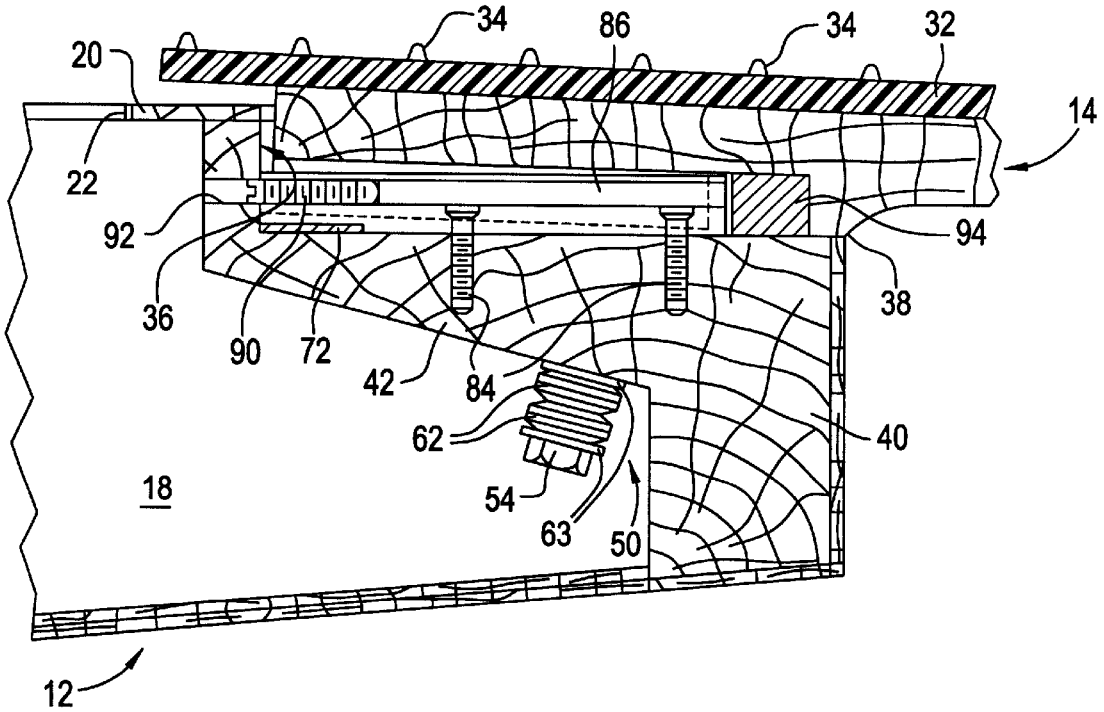
FIG. 5 is a side sectional view of the portion of the guitar shown in FIG. 2, taken along lines 5—5 of FIG. 2.
Figure 6:
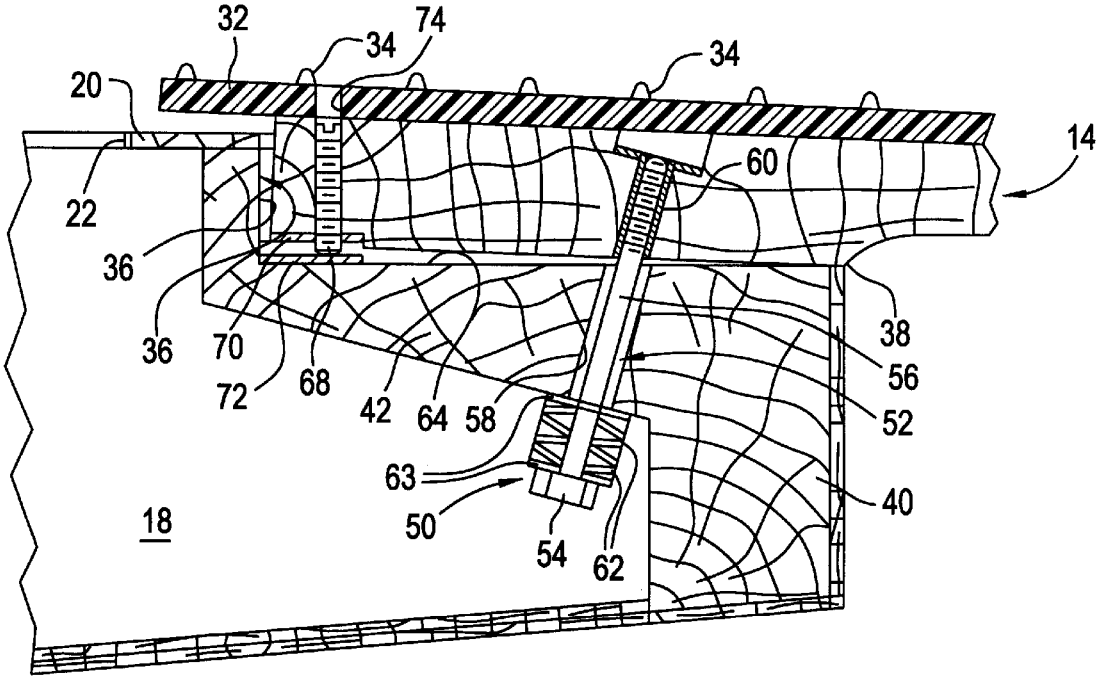
FIG. 6 is another side sectional view of the portion of the guitar shown in FIG. 2, taken along lines 6—6 of FIG. 2.

In accordance with one aspect of the present invention as illustrated in FIGS. 1–6, the neck 14 of the guitar 10 is adapted to be mounted in a recess 36 provided in the guitar body 12 in a secure and stable, yet adjustable manner so as to be capable of easily and quickly adjusting the action of the instrument 10. More particularly, the neck 14 is adapted to pivot or tilt about the forward edge 38 of the recess 36 in order to adjust the action of the instrument 10. The forward edge 38 of the recess 36 thus provides a fulcrum or pivot axis for the neck 14. Also, the position of the neck 14 in the longitudinal direction, i.e., the direction that the strings 16 extend, can be adjusted in a manner to be described hereinbelow to adjust the intonation of the strings 16. The intonation is determined by the harmonic length of the strings 16 which is the distance between the point at which the strings 16 are supported on the bridge 24 and the point at which the strings 16 are supported on the nut 26. It will be appreciated that with a fixed bridge 24, movement of the neck 14 in the longitudinal direction, i.e., left to right as shown in FIGS. 5 and 6, will adjust the spacing between the bridge 24 and the nut 26 to thereby change the harmonic length of the strings 16.

As best seen in FIGS. 3, 5 and 6 the recess 36 for the neck 14 is provided by means of a heel block 40 provided within the sound chamber 18 of the acoustic guitar 10 adjacent to the front end of the guitar body 12 from which the neck 14 extends outwardly. The size of the recess 36 generally corresponds to but is slightly larger than the size of the neck 14 to be received therein. The heel block 40, which preferably comprises a block of wood, includes a generally rectangular recess 36 in the top thereof extending from the front edge 38 of the guitar 10 rearwardly toward the sound hole 22 provided in the top soundboard 20. Beneath the soundboard 20 and inside the sound chamber 18 within the body 12, the heel block 40 at its forwardmost end extends to the bottom of the guitar 10 and includes a rearward extension 42 having an upwardly sloping bottom surface. The upwardly sloping bottom surface of the heel block extension 42 serves as the support surface for securing the neck 14 in place through the use of a pair of holding members 50, which in the embodiment shown in FIGS. 1–6 each comprise a spring-loaded threaded fastener or clamp.

More particularly, each of the spring-loaded threaded fasteners or clamps 50 comprises a bolt 52 having an enlarged head 54 and a threaded shaft 56. The shaft 56 of each bolt 52 extends through an opening 58 provided in the inclined extension 42 of the heel block 40 and is adapted to be received in a T-nut 60 provided in the neck 14, as best seen in FIG. 6. In this regard, the bolts 52 and T-nuts 60 are not arranged so as to be normal to the bottom surface 64 of the recess 36 in the heel block 40 or to the neck 14, but rather are inclined rearwardly so as to be generally normal to the inclined surface of the heel block extension 42. A series of spring members, which in the preferred embodiment are belleville washers 62, are provided between the heads 54 of the bolts 52 and the extension 42 of the heel block 40. Of course, the orientation of the bolt alternatively could be reversed (not shown) so that the shaft extends through a suitable opening in the neck, with the end of the shaft received in a suitable fastener (such as a T-nut or the like) provided in the body and with the spring member arranged between the head of the bolt and the neck. Because of the arrangement in which the neck 14 pivots about the fulcrum at the forward edge 38 of the recess 36, the spring members 62 serve to provide a biasing force for urging the neck 14 to pivot in a generally counterclockwise direction as viewed in FIG. 6 about the fulcrum at the forward edge 38. That is, the rearward end of the neck 14 which is received in the recess 36 is urged downwardly toward the bottom surface 64 of the recess 36 so that the bottom surface of the neck 14 will seat against the bottom surface 64 of the recess 36. In this regard, the inclined orientation of the spring-loaded bolts 52 serves to urge the neck 14 toward the rearward end of the recess 36 in the guitar body 12, as well as to urge the neck 14 to pivot downwardly to the fully seat in the recess 36. This biasing of the neck 14 by virtue of the action of the spring members 62, to urge the neck 14 rearwardly and to pivot in the counterclockwise direction as shown in FIG. 6, is also assisted by the tension of the strings 16 of the guitar 10.

An action adjustment member 68 is provided in the neck 14 which is adapted to oppose the biasing force created by the spring members 62 and to set the angular orientation of the neck 14. In the embodiment shown in FIGS. 1–6, the adjustment member comprises a threaded screw 68 which is threadably mounted in a T-nut 70 or other suitable piece of hardware provided in the neck 14 adjacent the rearward end thereof. The end of the adjustment screw 68 extends out of the bottom surface of the neck 14 and engages or bears against a pressure plate or block 72 provided in the bottom surface 64 of the recess 36. The screw 68 bearing against the plate 72 thus serves to "stop" further pivoting or downward movement of the neck 14. Rotating the screw 68 so as to retract the amount that it extends from the bottom surface of the neck 14 serves to allow the rearward end of the neck 14 to move downwardly further toward the bottom surface 64 of the recess 36 under the influence of both the spring members 62 and the strings 16, thus increasing the spacing between the strings 16 and the fingerboard. On the other hand, rotating the adjustment screw 68 so as to extend the end further out of the bottom surface of the neck 14 will force the rearward end of the neck 14 upwardly, further away from the bottom surface 64 of the recess 36, and decreasing the spacing between the fingerboard 32 and the strings 16. Thus, it will be appreciated that the adjustment screw 68 can be used to set the angular orientation of the neck 14 relative to the body 12, and thus the action of the guitar 10.

In the embodiment shown in FIGS. 1–6, rotation of the adjustment screw 68 is conveniently achieved through a suitable opening 74 provided in the fingerboard 32 which allows for insertion of a screw driver or like instrument to rotate the screw 68. In this regard, since the adjustment screw 68 is readily accessible through the top surface of the fingerboard 32, adjustment of the action of the instrument 10 can be conveniently and easily accomplished without having to loosen any bolts or fasteners. Preferably the adjustment member 68 be located toward the rear of the neck 14 in order that a small amount of rotation will serve to provide the desired amount of vertical movement of the end of the neck 14. Of course, the amount of movement as well as the size of the threads on the screw 68 may be varied as desired. Also, by locating the adjustment member 68 at a greater distance from the pivot axis 38, it will be easier to cause pivoting or tilting of the neck 14 about the fulcrum or front edge 38 against the biasing force of the spring washers 62.

In this regard, the belleville washers 62 provided between the heads 54 of the bolts 52 and the bottom of the heel block extension 42 serve to provide a convenient mechanism for accommodating movement of the neck 14 while maintaining a biasing force to hold the neck 14 in place. Thus, rotation of the adjustment screw 68 to pivot the neck 14 in a clockwise direction as shown in FIG. 6 will serve to flatten the belleville washers 62 as the heads 54 of the bolts 52 are pulled upwardly slightly by such rotation. Similarly, retraction of the adjustment screw 68 within the neck 14 allows the neck 14 to pivot in a counterclockwise direction about the fulcrum 38 and thus to move the heads 54 of the bolts 52 away from the heel block extension 42. This movement allows the belleville washers 62 to expand, while still maintaining a firm, stable, and essentially rigid connection between the neck 14 and the guitar body 12.

The belleville spring washers 62 utilized in the embodiment shown in FIGS. 1–6 thus provides a convenient, efficient spring member or members for providing the desired biasing force while still permitting limited movement of the neck 14. The overall amount of movement of the end of the neck 14 above the bottom surface 64 of the recess 36 should preferably be on the order of approximately 1/32" in order to provide for an approximately 1/8" movement of the strings relative to the top of the fingerboard 32, although a smaller or larger amount of movement may be provided. In the particular arrangement shown in FIG. 6, there are four belleville washers 62 for each bolt 52, arranged between a pair of flat washers 63. Each of the washers 62 preferably is able to accommodate approximately 0.008 inches of movement due to flattening. For 3/16" bolts 52, suitable belleville washers 62 may be obtained from Associated Spring Corp. under part No. BO562-028. Such washers 62 have an outside diameter of 0.562 inches, an inside diameter of 0.190 inches and provide a load capability of 78–96 pounds. As shown in FIG. 6, the washers 62 are arranged in opposing manners so that the total extent of movement which may be accommodated is approximately 1/32". To increase the amount of adjustment which can be accommodated, all that need be done is to increase the number of washers 62. To increase the power or force which is exerted by the belleville spring washers 62, the plurality of the belleville washers may be stacked one on top of the other so that each have the same orientation (as opposed to the opposing orientation as shown in FIG. 6).

The neck mounting system for the guitar 10 shown in FIGS. 1–6 also includes an intonation adjustment mechanism 80, as well as a rigidity enhancement mechanism for ensuring that a solid, stable structural joint is provided. In this regard, the intonation adjustment mechanism and rigidity enhancement mechanism is generally in accord with the principles taught in the U.S. Pat. No. 5,786,539, which is hereby incorporated by reference. More particularly, the intonation adjustment mechanism 80 in the embodiment shown in FIGS. 1–6 includes a hollow tubular housing 82 secured to the bottom surface 64 in the recess 36 of the heel block 40 of the body 12. The hollow tubular housing 82 has a longitudinal extending bore which is aligned with the general longitudinal direction of the neck 14 and the strings 16. The housing 82 is secured by a means of a pair of screws 84 which pass transversely though the tubular housing 82 and into the heel block 40. The mounting holes in the tubular housing 82 are countersunk so that the heads of the mounting screws 84 are below the extent of the longitudinal bore (see FIG. 5). A push rod or shaft 86 is slidably received within the longitudinally extending bore, and has an angled surface 88 at the end thereof which extends beyond the forward end of the tubular housing 82. A set screw 90 is threadably received in the rearward portion of the tubular housing 82 and engages the rearward end of the push rod 86. The end of the set screw 90 is accessible from inside the sound chamber 18 through an access hole 92 provided in the upwardly extending lip of the heel block extension 42. The set screw 90 serves to set the position of the push rod 86 and thus the extent that the angled forward surface 88 extends beyond the end of the tubular housing 82.

A pressure plate 94 having a complimentary angled surface 96 to that of the angled front end surface 88 of the push rod 86 is mounted in a recess 98 provided in the bottom surface of the neck 14, as best seen in FIG. 4. The recess 98 in the bottom of the neck 14 is for accommodating the tubular housing 82 of the intonation adjustment mechanism 80 when the neck 14 is mounted in the recess 36 of the guitar body 12. The neck recess 98 is sized so that the neck 14 may be fully seated in the recess 36 within the heel block 40 with the bottom surface of the neck 14 contacting the bottom surface 64 of the recess 36 and with the rearward end of the neck 14 contacting the rear wall of the recess 36 in the heel block 40. Also, the pressure plate 94 in the neck 14 is arranged to be slightly forward of the front end of the tubular housing 82 (which may also be angled as shown in FIG. 3) when the neck 14 is fully seated in its rearwardmost position within the guitar body 12. However, in actual use, the rearward end surface of the neck 14 is spaced forwardly a slight distance from the rear wall of the recess 36, so as to ensure that the neck 14 can pivot about the fulcrum 38 without interference of the rear wall of the recess 36.

In accordance with the principles of the aforementioned U.S. Pat. No. 5,786,539, it will be appreciated that the disclosed arrangement thus provides both intonation adjustment as well as a rigid stable connection of the neck 14 to the body 12. More particularly, by rotation of the set screw 90, the push rod 86 which is in engagement with the pressure plate 94 can be moved outwardly relative to the tubular housing 82 to force the neck 14 longitudinally outward to set the intonation of the instrument 10 as will be apparent from the discussion hereinbelow. Also, because of the interaction of the angled surfaces 88, 96 on the push rod 86 and pressure plate 94, respectively, the neck 14 will be urged laterally sideways into firm contact with the side surface 37 of recess 36 to provide a rigid, stable firm joint, as also explained more fully hereinbelow.

In assembling the neck 14 to the body 12, the end of the neck 14 is positioned in the recess 36 and the threaded fasteners 52, with the belleville washers 62 thereon, are threaded upwardly through the holes 58 in the heel block extension 42 and screwed into the T-nuts 60 or other similar hardware provided in the neck 14. As the fasteners 52 are threaded into the T-nuts 60, the set of belleville washers 62 (between the flat washers 63) are positioned against the inclined bottom surface of the heel block extension 42. Continued rotation of the fasteners 52 serves to flatten the belleville washers 62 and create a biasing force urging the rear end of the neck 14 downwardly within the recess 36. The desired angular orientation of the neck 14 relative to the body 12, and consequently the action of the guitar 10, is adjusted and set by the adjustment screw 68.

The recess 98 in the bottom of the neck 14 serves to accommodate the intonation adjustment housing extending upwardly from the bottom surface 64 in the recess 36, as noted hereinabove. Also, the forward end of the push rod 86 having the angled end face 88 engages the complimentary angled surface 96 on the pressure plate 94 within the neck 14. The intonation of the strings 16 is set by rotating the intonation set screw 90 to urge the push rod 86 forwardly to the desired extent. This is easily accomplished by simply placing one's hand through the sound hole 20 of the guitar body 12 and inserting a small screw driver or other tool into the access hole 92 to engage and rotate the intonation set screw 90. Continued rotation of the set screw 90 serves to force the neck 14 forwardly against the tension of the strings 16. In addition, by virtue of the angled orientation on the end face 88 of the push rod 86 and the angled surface 96 of the pressure plate 94, the neck 14 is urged sidewardly against the side surface 37 of the recess 36, i.e., toward the side surface 37 as shown in FIG. 3. In this regard, because of the angled surfaces 88, 96 on the push rod 86 and the pressure plate 94, respectively, the neck 14 is always tightly urged against the side surface 37 of the recess 36, irrespective of the precise longitudinal position of the neck 14 within the recess 36. Thus, the intonation adjustment mechanism 80 will set the intonation of the instrument 10 by setting the relative longitudinal position of the neck 14 within the recess 36, and at the same time, will provide a rigid, firm contact for the neck 14 against the side surface 37 of the recess 36.

Figure 7:
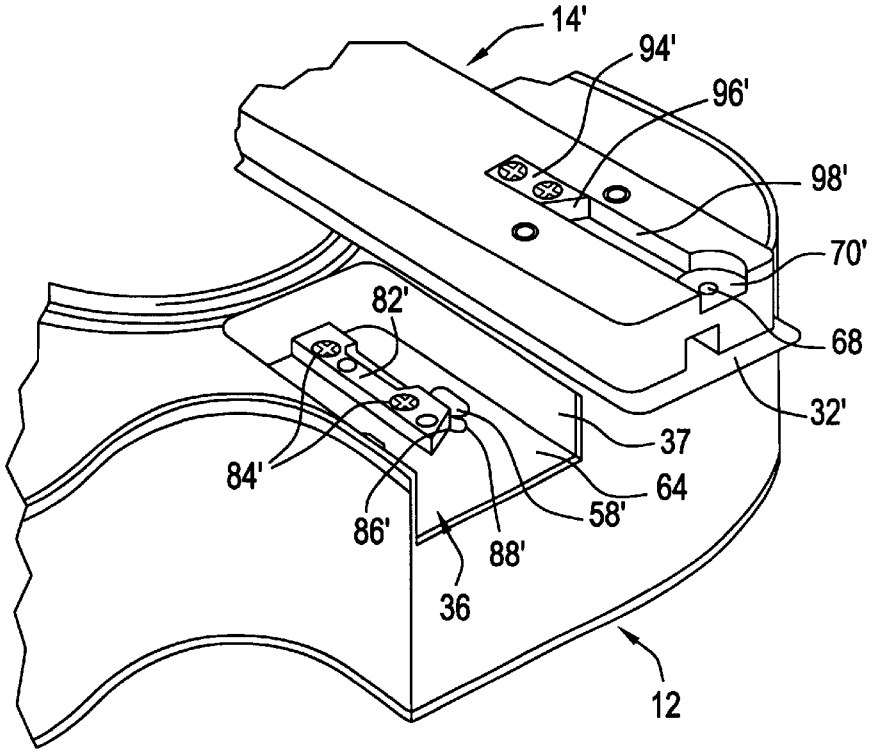
FIG. 7 is a partial perspective view of another embodiment of a guitar in accordance with the present invention, illustrating a recess or pocket in the body for receiving the neck, and also illustrating a bottom perspective view of the end of the neck to be secured in such recess.
Figure 8:
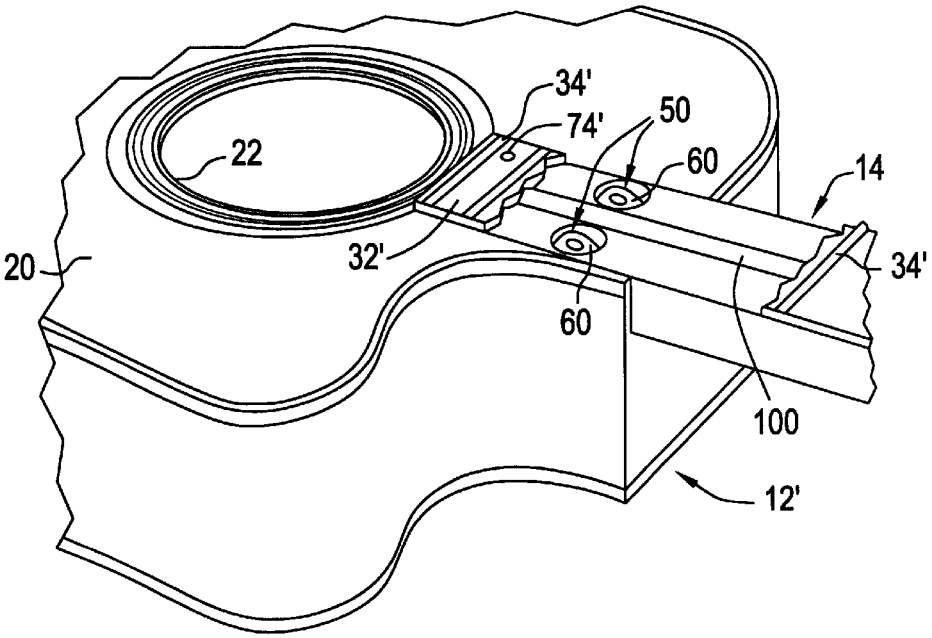
FIG. 8 is a partial perspective view of the guitar shown in FIG. 7, but having the neck secured in place to the body, partially broken away for clarity to illustrate the neck provided with a reinforcing truss.

As noted above, in the embodiment shown in FIGS. 1–6, the intonation adjustment mechanism 80 comprises a generally tubular housing 82 having a pair of mounting holes extending transversely through the bore thereof. FIGS. 7 and 8 show an alternative arrangement for the intonation adjustment mechanism in which an intonation adjustment block 821 has a generally rectangular shape and in which the mounting screws 84' are arranged to one side of the longitudinal bore through which the push rod 86' extends. This arrangement, of course, means that the width of the recess 98' in the bottom of the neck 14' must be greater to accommodate the increased width of the intonation adjustment block 82'.

In addition, with the embodiment shown in FIGS. 7 and 8, the location of the action adjustment screw 68' has been moved so as to be directly above a flat portion of the intonation adjustment block 82' but displaced to one side of the mounting screws 84'. Thus, no separate pressure plate is required; instead the housing 82' serves as the bearing surface for contact by the action adjustment screw 68'. Although, it is preferable to locate the action adjustment member 68' toward the centerline of the neck 14' in order to prevent possible tilting or canting of the neck 14' within the recess 36', it is not necessary that it be located precisely along the centerline. For instance, the action adjustment member 68' may be offset to accommodate other components in the neck 14', such as a central truss rod 100 for strengthening the neck 14', as shown in FIG. 8.

The mounting device illustrated in the embodiment of FIGS. 1–6 is particularly useful in connection with a hollow body acoustic guitar 10 in which the hollow sound chamber 18 and the sound hole 22 provide for easy, convenient access for assembly of the fasteners 52 and belleville washers 62, and for intonation adjustment. Action adjustment is easily and conveniently accomplished through the small hole 74 provided in the fingerboard 32 which provides access to the action adjustment screw 68. However, a hollow sound chamber and sound opening is not provided in solid body electric guitars which, as the name implies, have a solid instrument body. Furthermore, in a solid body electric guitar, it is desired that the fasteners for securing the neck 14 to the body 12 not protrude to a great extent from the surface of the body 12. Also, some mechanism for providing intonation adjustment and/or rigiditis enhancement which does not require a hollow sound chamber is desirable. FIGS. 9–19 illustrate several other examples of mounting devices and arrangements in accordance with the principles of the present invention which are particularly adapted for use with solid body electric guitars. It will be appreciated, however, that while the embodiments shown in these figures are particularly adapted for solid body electric guitars which do not have a hollow sound chamber, they could nevertheless be employed in acoustic guitars as well, as persons skilled in the art will readily appreciate.

Figure 13:
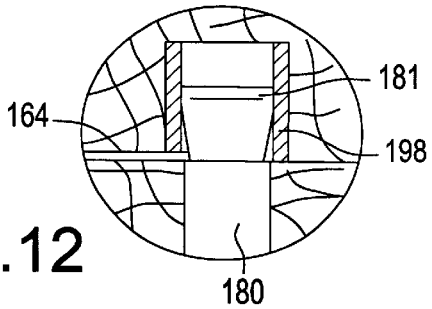
FIG. 13 is an enlarged fragmentary view of the intonation pin in the guitar shown in FIG. 10.
Figure 12:
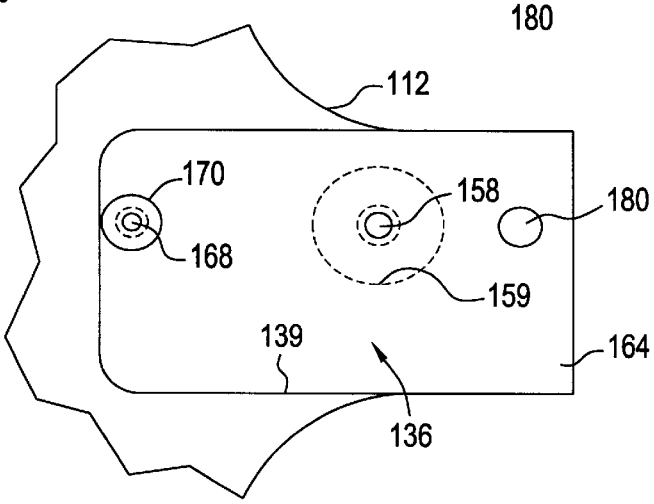
FIG. 12 is a partial plan view of the body of the guitar shown in FIG. 9, with the neck having been removed for clarity.

In the embodiment of the present invention which is illustrated in FIGS. 9–13, no separate intonation adjustment mechanism is provided. However, the mounting arrangement is such as to provide for easy and convenient action adjustment of the neck 114, while also providing a firm, rigid and stable mounting of the neck 114 to the guitar body 112. More particularly, in accordance with this embodiment, the solid body 112 of the electric guitar 110 is provided with a generally rectangular recess 136 for receiving the end of a guitar neck 114. Again, the neck 114 of the guitar 110 includes a fingerboard 132 secured to the upper surface thereof. The instrument 110 includes an upstanding intonation pin 180 secured in the body recess 136 and extending upwardly above the bottom surface 164 of the recess 136. The end 181 of the intonation pin 180 is adapted to be received within a generally cylindrical sleeve 198 provided in the bottom of the neck 114 to provide a fixed pin to set the intonation position of the neck 114 of the guitar 110. If desired and as is well known, an adjustable bridge (not shown) could be provided which has the ability to adjust the position or location of the bridge on the top of the body. Preferably, the end 181 of the intonation pin 180 has been machined in a manner so as to provide a partial ball shape at the upper end which then tapers inwardly to a slight extent along the length of the pin 180, for example, on the order of a 5° taper, in order to permit easy tilting of the neck 114 about the intonation pin 180. This is best illustrated in FIG. 13. The length of the taper corresponds generally to the distance that the end 181 of the intonation pin 180 extends upwardly from the bottom surface 164 of the recess 136 in the body 112.

In the embodiment shown in FIGS. 9–13, the mounting device again comprises a spring-loaded fastener 150 that serves to secure the neck 114 and body 112 together. More particularly, a single threaded fastener bolt 152 is provided, arranged in a generally normal direction to the top surface of the guitar 110 and spring-loaded to pull the rearward end of the neck 114 downwardly. The neck 114 is provided with a T-nut 160 or other similar piece of hardware for receiving the threaded end of the fastener bolt 152. The shaft 156 of the bolt 152 extends upwardly through a hole 158 in the body 112, passing through the entire extent of the body 112, through the bottom surface 164 of the recess 136, and threaded into the T-nut 160 in the neck 114. At the bottom of the body 112, an enlarged countersunk recess 159 is provided for accommodating a plurality of belleville washers 162 arranged between the head 154 of the bolt 152 and the bottom of the recess 159 so that the washers 162 and the head 154 of the bolt 152 do not protrude to a great extent beyond the bottom surface of the body 112. In this embodiment, it should be noted that the diameter of the belleville washers 162 is greater than those in the embodiment shown in FIGS. 1–6. The large diameter belleville washers 162 each accommodate a larger amount of movement and also provide an increase in the spring biasing force. Consequently, only three washers 162 are necessary in the embodiment of FIGS. 9–13, while still providing an overall force on the order of approximately 100 pounds.

Figure 11:
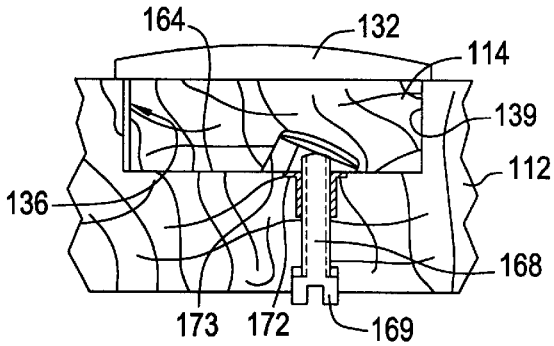
FIG. 11 is a sectional view of the guitar shown in FIG. 9, taken along lines 11—11 of FIG. 9.

Adjustment of the tilt of the neck 114 is accomplished again through a threaded adjustment screw 168. However, in contrast to the embodiment shown in FIGS. 1–6, the action adjustment screw 168 is mounted in the body 112 and engages an angled pressure plate 172 provided in the bottom of the neck 114 at the rearward end thereof. More particularly, the adjustment screw 168 is mounted in a T-nut 170 provided in the body 112 and extending downwardly from the recess or pocket 136. The adjustment screw 168 extends through the full extent of the body 112, with the head 169 thereof accessible from the bottom of the guitar 110 in order to be able to rotate the screw 168. A suitable countersunk recess 171 is provided in the bottom surface of the body 112 for accommodating the head 169 of the adjustment screw 168. The pressure plate 172 against which the action adjustment screw 168 acts is provided in a recess 173 in the bottom of the neck 114 and is arranged at a compound angle so as to be angled towards one side of the neck 114 (as illustrated in FIG. 11) and also to be angled toward the rear portion of the recess 136 in the neck 114.

Figure 9:
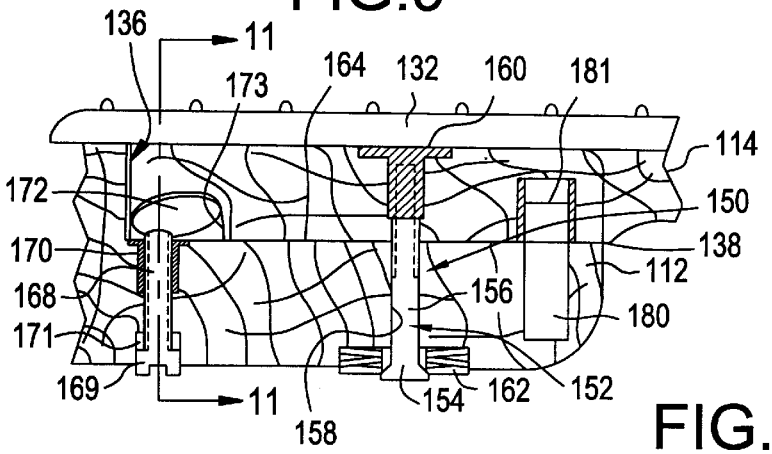
FIG. 9 is a side sectional view of a further embodiment of a guitar in accordance with the present invention, illustrating a solid body electric guitar in which the neck is shown mounted in its lowermost position in a recess of the guitar body.
Figure 10:
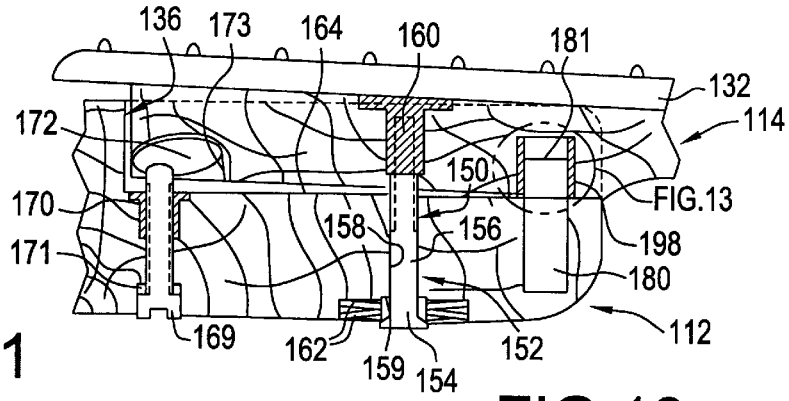
FIG. 10 is a further side sectional view similar to FIG. 9, but illustrating the rear end of the neck having been tilted upwardly to lower the action of the guitar.

As with the embodiment shown in FIGS. 1–6, the action adjustment screw 168 acts against the biasing force provided by the belleville washers 162 and is moveable to adjust the angle of tilt of the neck 114 relative to the body 112, and thus, the action of the guitar 110. FIG. 9 illustrates the neck 114 being arranged at its lowestmost position seated against the bottom surface 164 of the recess 136. Rotation of the adjustment screw 168 causes the end of the screw 168 to move upwardly against the pressure plate 172 affixed within the neck 114 to raise the rear end of the neck 114 and force the neck to tilt about the intonation pin 180, as illustrated in FIG. 10. In. this regard, the machining at the end of intonation pin 180 assists in accommodating the tilting motion of the neck 114 as the sleeve 198 pivots about the end of the intonation pin 180. Preferably, the neck 114 is able to tilt away from bottom surface 164 on the order of about 2°, which will thus raise of the end of the neck 114 on the order of 1/32". However, a larger or smaller amount of action adjustment could be provided if desired.

It will be appreciated that the intonation pin 180 fixes the position of the neck 114 and prevents any horizontal movement—either longitudinally or laterally—but does allow tilting motion of the neck 114 relative to the body 112. In order to provide enhanced rigidity, the rear portion of the neck 114 is forced sidewardly by virtue of the angled orientation of the pressure plate 172 in the neck 114. In the preferred embodiment, the pressure plate 172 is oriented at angle of approximately 22.5° from the horizontal in the sideways direction (as best seen in FIG. 11) in order to force the side the neck 114 against the side 139 of the recess 136 when engaged by the end of the action adjustment screw 168. In essence, this provides a slight swinging of the neck 114 in the sideways direction about the intonation pin 180. In addition, the pressure plate 172 is also angled backwardly so that the interaction of the adjustment screw 168 against the plate 172 urges the neck 114 in the longitudinal direction toward the rear of the recess 136 in the body 112. The angle of orientation of the plate 172 in the longitudinal direction (as shown in FIGS. 9 and 10) can be less than that in the lateral direction, for example in the order of about 15°.

Accordingly, the angled orientation of the pressure plate 172 acted on by the action adjustment screw 168 in opposition to the biasing force of the belleville washers 162 serves to increase the rigidity and stability of the mounting of the neck 114 by ensuring that the neck 114 is urged tightly up against the side wall 139 of the recess 136 and rearwardly against the intonation pin 180, irrespective of the amount of tilting of the neck 114 relative to the body 112. In this regard, while the intonation pin 180 does tightly fit within the neck sleeve 198, there is some play, and thus, the interaction of the adjustment screw 168 against the angled pressure plate 172 takes up that play to thereby provide a rigid, stable connection of the neck 114 to body 112.

Figure 14:
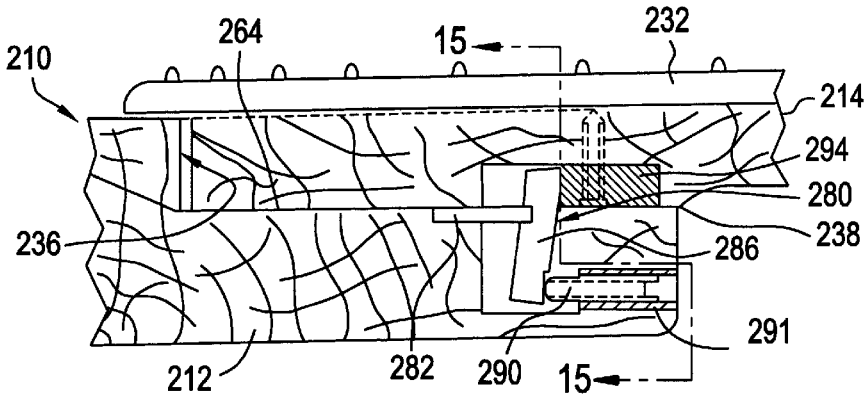
FIG. 14 is a side sectional view of another embodiment of a solid body electric guitar in accordance with the present invention, illustrating a different type of intonation adjustment mechanism.
Figure 15:
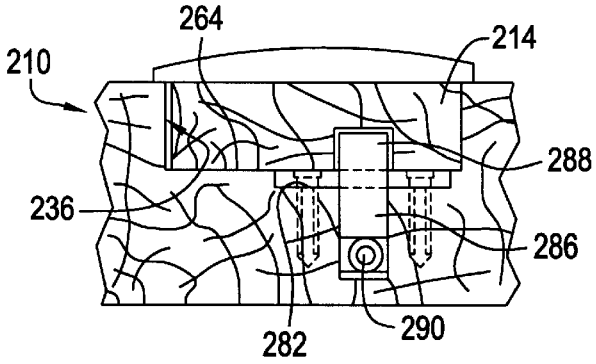
FIG. 15 is a sectional view of the guitar shown in FIG. 14, taken along lines 15—15 of FIG. 14.
Figure 16:
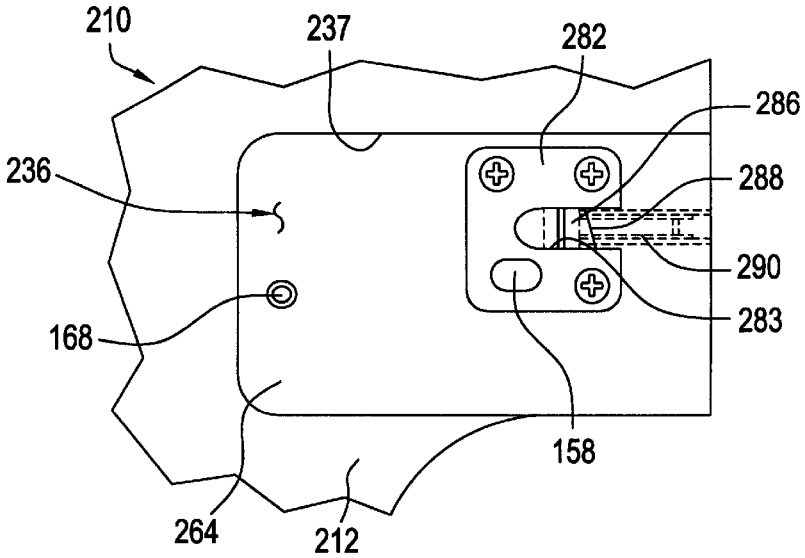
FIG. 16 is a plan view of the body of the guitar shown in FIG. 14, with the neck removed for clarity.

FIGS. 14–16 illustrate a further embodiment of a solid body electric guitar 210 in accordance with the present invention which includes an intonation adjustment mechanism 280 instead of the intonation pin 180 as shown in the embodiment of FIGS. 9–13. Although not shown in FIGS. 14–16, a spring-loaded fastener 150 and action adjustment screw 168 as illustrated in the embodiment of FIGS. 9–13 are employed. Thus, a single mounting bolt or threaded fastener 152 is provided which extends upwardly through the body 212 and has its end received in a T-nut 160 or other similar piece of hardware, with a plurality of belleville washers 162 being provided to urge the rearward end of the neck 214 downwardly. However, instead of being pivotable about an upstanding intonation pin 180, the neck 214 is pivotable about the forward edge 238 of the recess or pocket 236 provided in the body 212. The action adjustment screw 168 (not shown) is also preferably accessible from the bottom of the guitar body 212 and passes upwardly through the body and beyond the bottom surface 264 of the recess 236 to engage a pressure plate 172 (not shown) provided in the neck 214 and angled so as to urge the neck 214 both rearwardly and toward one side of the recess 236.

In the embodiment shown in FIGS. 14–16, the intonation adjustment mechanism 280 is operative to adjust the position of the neck 214 in the longitudinal direction, and thus, change the harmonic length of the strings of the instrument 210. The intonation adjustment mechanism 280 comprises a rocker arm 286 arranged to pivot about a transverse axis and engage a pressure plate 294 provided in the neck 214 to move the neck 214 longitudinally. The rocker arm 286 is supported to pivot by means of a mounting plate 282 provided in the bottom of the recess or pocket 236 for the neck 214 so as to be flush with the bottom surface 264. The mounting plate 282 includes a generally U-shaped slot 283 along the forward edge to receive and mount the rocker arm 286 for pivotal movement about an axis extending across the slot 283. In this regard, the rocker arm 286 may comprises a block having a recessed section for being received in the U-shaped slot 283 in the mounting plate 282 and to pivot thereabout. The body 212 is routed beneath the mounting plate 282 to accommodate the lower end of the rocker arm 286 when it pivots. Pivoting of the rocker arm 286 is accomplished by means of an intonation adjustment screw 290 which acts on the lower end of the rocker arm 286 in the cavity beneath the mounting plate 282. The intonation adjustment screw 290 is received in a sleeve 291 extending generally horizontally toward the forward end of the body 212 so as to be accessible from outside of the body 212. The intonation adjustment screw 290 thus moves in a generally horizontal direction as shown in FIG. 14, with the end thereof engaging the lower end of the rocker arm 286 to move same in the rearward direction to thus pivot the top end of the rocker arm 286 forwardly.

The neck 214 is provided with a pressure block 294 arranged to be contacted by the upper end of the rocker arm 286, as shown in FIG. 14. The contact face 288 of the upper end of the rocker arm 286 is preferably angled to the side (as shown in FIG. 16), and the pressure block 294 in the neck 214 has a complementary angled surface (not shown) to be contacted thereby. With this arrangement, when the contact face 288 of the rocker arm 286 contacts the complimentary angular face of the pressure block 294, the neck 214 will be forced sideways against the side wall 237 of the recess 236, namely towards the top side as shown in FIG. 16, in order to provide enhanced rigidity and stability. In this regard, the strings of the instrument 210 provide tension for urging the neck 214 generally rearwardly, as does the action adjustment screw 168 (not shown in FIGS. 14–16) contacting the angled pressure plate 172 (not shown in FIGS. 14–16) in the rear bottom surface of the neck 214. The urging of the neck 214 sideways against the body 212 is also assisted by the angled pressure plate 172 acted on by the adjustment screw 168 to thereby provide a solid, rigid connection for the neck 214 against the side wall 237 of the recess 236. Rotation of the intonation adjustment screw 290 serves to pivot the rocker arm 286 about the mounting plate 282 and to force the neck 214 longitudinally outward to adjust the intonation of the instrument 210. Retraction of the intonation screw 290 allows the force of the strings to move the neck 214 rearwardly and pivot the rocker arm 286 in the counter-clockwise direction as shown in FIG. 14. Again, the angled contact faces on the rocker arm 286 and the pressure block 294, and the sideways orientation of the rear pressure plate 172 (not shown) acted on by the action adjustment screw 168 (not shown), still serve to urge the neck 214 sideways into firm contact with the side wall 237 of the recess 236.

Figure 17:
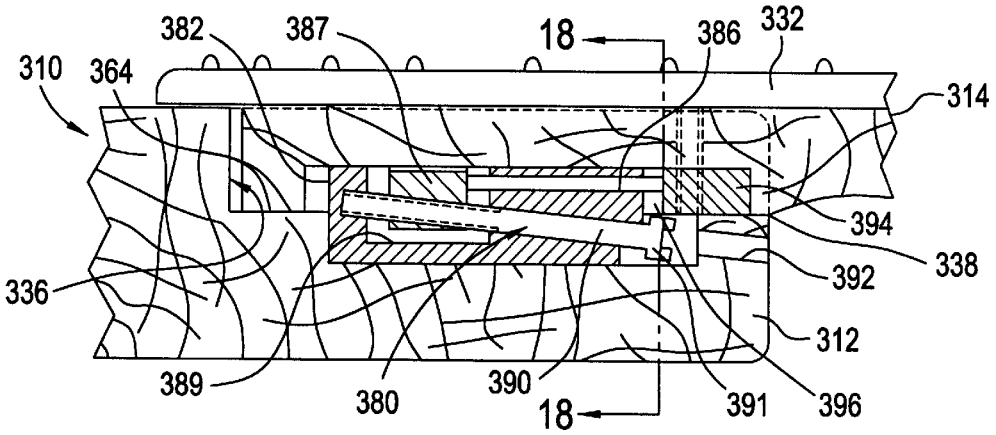
FIG. 17 is a side sectional view of a further embodiment of a solid body electric guitar in accordance with the present invention, illustrating a further embodiment of an intonation adjustment mechanism.
Figure 18:
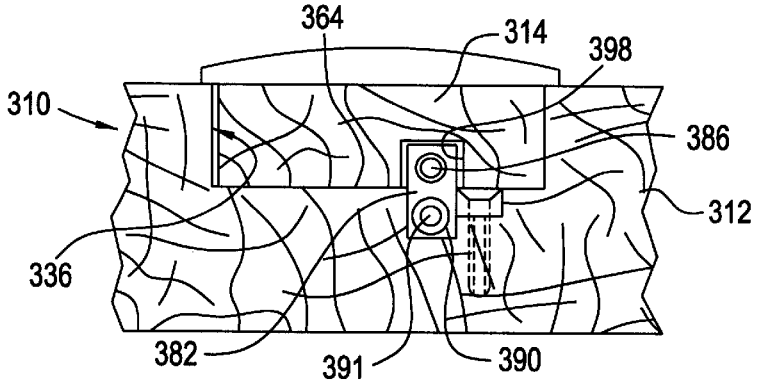
FIG. 18 is a sectional view of the guitar shown in FIG. 17, taken along lines 18—18 of FIG. 17.
Figure 19:
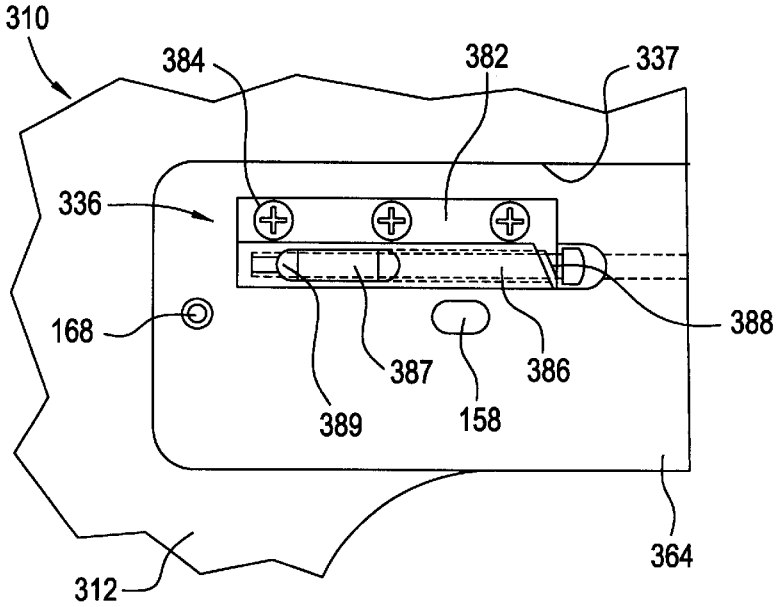
FIG. 19 is a plan view of the body of the guitar shown in FIG. 17, with the neck removed for clarity.

A still further embodiment of an intonation adjustment mechanism 380 for a solid body electric guitar 310 is illustrated in FIGS. 17–19. Once again, the neck 314 of the instrument 310 is adapted to pivot about a fulcrum at the front edge 338 of the pocket or recess 336 in the guitar body 312. A single spring-loaded clamp 150 (not shown) and an action adjustment screw 168 (not shown) are also provided in the body 312, and a pressure plate 172 (not shown) is provided in the neck 314, similar to those illustrated in the embodiment of FIGS. 9–13. In this regard, the hole 158 provided in the body for the bolt 152 is illustrated in FIG. 19, as is the end of the action adjustment screw 168, both of which are arranged generally on the centerline of the recess 336 for the neck 314.

To one side of the centerline, the body 312 is routed to receive an intonation adjustment housing 382 having a longitudinally extending bore which receives a push rod 386 so as to be freely slidable longitudinally therein. The intonation adjustment housing 382 is mounted in place by means of screws 384 provided in a flange extending laterally to one side of the housing 382 (see FIGS. 18 and 19). To move the push rod 386, a push block 387 is arranged in a slot 389 passing vertically through the housing 382 and the longitudinal extending bore. The push block 387 has a threaded opening therethrough arranged generally in the longitudinal direction but at an angle to the horizontal to receive a threaded intonation adjustment screw 390, as best seen in FIG. 17. The adjustment screw 390 passes through an angled bore in the housing 382 with the head 391 of the screw 390 being at the forward end of the guitar body 312 and at a lower elevation beneath the bore for the push rod 386 (see FIGS. 17 and 18). The body 312 of the instrument 310 is also routed at the forward end of the recess to receive the head 391 of the intonation adjustment screw 390, and an intonation access hole 392 is provided in alignment with the head 391 and passing to the outside of the body 312 beneath the neck 314.

The neck 314 is provided with a suitable recess 398 in the bottom thereof to receive the housing 382 to permit relative longitudinal movement of the neck 314 within the recess 336. A pressure block 394 is provided at one end of the recess 398 in the neck 314 to be contacted by the end of the push rod 386. Rotation of the intonation adjustment screw 390 serves to move the push block 387 within the slot 389 in the housing 382. The forward end of the push block 387 is arranged to engage the rear end of the push rod 386 to cause the push rod 386 to move longitudinally within the housing 382. The push rod 386 in turn contacts the pressure block 394 in the neck 314 to adjust the longitudinal position of the neck 314 relative to the body 312 to set the intonation of the instrument 310. The forward end of the push rod 386 preferably includes an angled face 388, as does the end 396 of the pressure block 394 in the neck 314, similar to the arrangements shown in FIGS. 2 and 7. The angled faces 388, 396 on the push rod 386 and the pressure block 394 within the neck 314 are such so as to urge the neck 314 sideways into a solid, firm relationship against the side wall 337 of the recess 336 to provide enhanced rigidity of the mounting of the neck 314 to the body 312. Once again, the tension of the strings of the instrument 310 and the interaction of the action adjustment screw 168 against the angled pressure plate 172 serve to provide a biasing force to ensure that the push rod 386 remains in contact with the pressure block 394 and thus to urge the neck 314 sideways into a firm, stable mounting.

It will thus be appreciated that in accordance with the present invention, there is provided an improved mounting device for securing the neck 14 to the body 12 of a stringed musical instrument 10 which enables a stable, rigid attachment while permitting easy and quick adjustment of the action of the instrument, without requiring the loosening of mounting bolts or other fasteners, adjusting the action and then re-tightening of the fasteners. In accordance with the present invention, the neck 14 is mounted to the body 12 in a manner to permit movement of the neck between first and second positions and with the neck 14 being urged toward the first position by a biasing force provided by at least one spring member 62. An action adjustment member 68 is movably mounted in one of the neck 14 or body 12 and is adapted to engage the other of the neck 14 or body 12. The action adjustment member 68 is operative against the biasing force provided by the spring member 62 to cause the neck 14 to move away from the first position to thereby adjust the position of the neck 14 relative to the body 12.

Conveniently, and in accordance with a preferred embodiment, the body 12 is provided with a recess or pocket 36 for receiving the neck 14, and the neck 14 is adapted to be pivotally mounted therein. The mounting device may conveniently comprise a spring-loaded, threaded fastener 52 for securing the neck 14 to the body 12 with the fastener 52 engaging the neck 14 and the spring member 62 being operatively arranged between the head 54 of the fastener 52 and the body 12 to urge the neck 14 to pivot in a first direction toward a seating surface 64 in the recess 36. Alternatively, the orientation of the fastener could be reversed (not shown) so that the fastener extends through the neck and engages the body, with the spring member operatively arranged between the head of the fastener and the neck. The action adjustment member 68 also conveniently comprises a threaded member which is provided in one of the neck 14 or the body 12 and which contacts the other of the neck 14 and body 12 to cause the neck 14 to pivot away from its seating position. The spring member 62 serves to provide a sufficiently strong loading force so that the neck may be easily maintained in a solid mounting position, yet capable of limited angular movement through a simple adjustment, such as rotation of an adjustment screw 68. In one preferred embodiment, the action adjustment screw 68 is manipulated through an opening 74 provided in the fingerboard 32 of the neck 14. Alternatively, the action adjustment screw 168 could be manipulated from the bottom of the body 112.

Also in accordance with a preferred embodiment of the present invention, the mounting device provides a mechanism for enhancing rigidity of the mounting of the neck 14 to the body 12 and/or intonation adjustment. Enhanced rigidity is provided by employment of a pressure plate or block 94, provided in the neck 14 and having an angled surface 96, which is adapted to be engaged by a bearing member 86 provided in the body 12 and having an angled contact surface 88. The angled contact surfaces 88, 96 are arranged so that the neck 14 is urged into sideways against the side 37 of the recess 36 in the body 12 as a result of the neck being biased by the mounting device and/or the tension of the strings 16 of the instrument 10. Advantageously, in the case of an acoustic guitar 10, a separate heel block arranged forwardly of the body 12 beneath the neck 14 is not necessary to provide a rigid stable mounting; rather, a heel block 40 may be provided in the sound chamber 18 and have a pocket or recess 36 for the neck 14 which may be solidly mounted therein. Consequently, it is possible for a musician or player to easily use the entire length of the fingerboard 32 during play of the instrument 10. Intonation adjustment may also be conveniently provided in either acoustic, electric and acoustic electric stringed musical instruments, together with the rigidity enhancement by arranging the bearing member 86 to move in a generally longitudinal direction to adjust the longitudinal position of the neck 14 to in turn adjust the intonation of the instrument 10.

The present invention is thus useable both with respect to acoustic guitars and solid body electric guitars and acoustic electric guitars, as well as with other stringed musical instruments in which there is a body 12 and a neck 14 along which the strings 16 are stretched.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A stringed musical instrument comprising:

an instrument body having a recess to receive a neck, said recess having a bottom surface;

a longitudinally extending neck having an end and a bottom mounting surface at said end to be received in said recess of said body;

a plurality of strings attached to said body and said neck;

a mounting device engaging said neck and said body for securing said neck in said recess of said body, said mounting device being operative so as to permit said neck to pivot about a pivot axis transverse to the longitudinal extent of said neck between a first position in which said bottom mounting surface of said neck engages said bottom surface of said recess and a second position in which at least a portion of said bottom mounting surface is disposed away from said bottom surface of said recess, and said mounting device comprising at least one bolt having a shaft and a head, said shaft of said bolt being arranged to extend at least partially through said neck and said body and through said bottom surface of said recess and said bottom mounting surface of said neck, and arranged to engage one of said neck and said body, and said bolt being arranged at an inclined angle relative to said bottom surface of said recess;

at least one spring member operatively arranged to provide a biasing force acting on said neck and said body to urge said neck towards said first position, said at least one spring member being arranged about said shaft of said bolt and positioned between said head of said bolt and said one of said neck and said body; and an adjustment member operatively arranged with respect to said neck and said body so as to oppose said biasing force, said adjustment member being positioned remote from said pivot axis and being moveable so as to cause said neck to pivot about said pivot axis to adjust the angular position of said bottom mounting surface of said neck relative to said bottom surface of said recess to thereby adjust the position of said strings relative to said neck.

2. The stringed musical instrument of claim 1, wherein said recess in said body has a front edge, and wherein said pivot axis is located along said front edge of said recess.

3. The stringed musical instrument of claim 1, wherein said at least one spring member comprises at least one belleville spring washer arranged between said head of said bolt and said one of said neck and said body.

4. The stringed musical instrument of claim 3, further including a plurality of said belleville spring washers arranged between said head of said bolt and said one of said neck and said body.

5. The stringed musical instrument of claim 1, wherein said bolt is inclined along a direction so that said biasing force of said at least one spring member includes a force component along said longitudinal direction of said instrument.

6. The stringed musical instrument of claim 1, wherein said body includes a heel block in which said recess is provided; wherein said bolt extends through a bore provided in said heel block with the end of said shaft of said bolt engaging said neck; and wherein said at least one spring member is arranged about said bolt between said head of said bolt and said heel block and is operative to force said head of said bolt away from said heel block.

7. The stringed musical instrument of claim 6, wherein there are two bolts for securing said neck to said body.

8. The stringed musical instrument of claim 1, wherein said adjustment member is mounted on said one of said neck and said body at a predetermined distance from said pivot axis, and wherein said at least one holding member is arranged so as to be located at a distance from said pivot axis which is less than said predetermined distance.

9. The stringed musical instrument of claim 1, wherein said adjustment member is located so as to at least partially extend through said recess in said body.

10. The stringed musical instrument of claim 1, wherein there are a plurality of said bolts, each of which has at least one of said spring members operatively associated therewith.

11. The stringed musical instrument of claim 1, wherein said adjustment member is mounted on said neck, and wherein said body includes a bearing surface provided in said recess and arranged to be contacted by said adjustment member.

12. The stringed musical instrument of claim 11, wherein said adjustment member is threadably mounted on said neck and is rotatable to adjust the amount that the end of said adjustment member extends from said bottom mounting surface of said neck.

13. The stringed musical instrument of claim 12, wherein said neck includes a fingerboard having frets on the surface thereof below said strings, and wherein said fingerboard includes an opening therein to provide access through the surface of said fingerboard to rotate said adjustment member.

14. The stringed musical instrument of claim 1, wherein said adjustment member is mounted in said body and is accessible from the bottom of said body.

15. The stringed musical instrument of claim 1, wherein said instrument body comprises an acoustic guitar body.

16. The stringed musical instrument of claim 1, wherein said instrument body comprises a solid electric guitar body.

17. The stringed musical instrument of claim 1, wherein said strings exert a tension on said neck to cause said neck to pivot in a direction toward said first position.

18. The stringed musical instrument of claim 1, wherein adjustment of the position of said neck between said first and second positions is accomplished by moving said adjustment member without adjusting said mounting device.

19. A stringed musical instrument comprising:

an instrument body having a recess to receive a neck, said recess having a bottom surface;

a longitudinally extending neck having an end and a bottom mounting surface at said end to be received in said recess of said body;

a plurality of strings attached to said body and said neck;

a mounting device engaging said neck and said body for securing said neck in said recess of said body, said mounting device being operative so as to permit said neck to pivot about a pivot axis transverse to the longitudinal extent of said neck between a first position in which said bottom mounting surface of said neck engages said bottom surface of said recess and a second position in which at least a portion of said bottom mounting surface is disposed away from said bottom surface of said recess, and said mounting device including an upstanding pin extending upwardly from said bottom surface of said recess and through said bottom mounting surface of said neck;

at least one spring member operatively arranged to provide a biasing force acting on said neck and said body to urge said neck towards said first position; and an adjustment member mounted on one of said neck and said body and engaging the other of said neck and said body, said adjustment member being positioned remote from said pivot axis and operative to act against said biasing force, and being moveable so as to cause said neck to pivot about said pivot axis to adjust the angular position of said bottom mounting surface of said neck relative to said bottom surface of said recess to thereby adjust the position of said strings relative to said neck.

20. The stringed musical instrument of claim 19, wherein said upstanding pin is secured to said body and said neck has a recess extending from said bottom mounting surface for receiving said pin.

21. The stringed musical instrument of claim 20, wherein the end of said pin received in said recess in said neck has an end shaped so as to permit tilting of said neck relative to said pin.

22. A stringed musical instrument comprising:

a neck having a longitudinal axis, an end and a bottom mounting surface at said end;

an instrument body having a recess to receive said bottom mounting surface of said neck, said recess having a bottom surface and at least one side surface which extends substantially parallel to said longitudinal axis of said neck;

a plurality of strings attached to said body and said neck;

a mounting device engaging said neck and said body for securing said neck in said recess of said body, said mounting device being operative so as to permit said neck to move between a first position in which said bottom mounting surface of said neck engages said bottom surface of said recess and a second position in which at least a portion of said bottom mounting surface is disposed away from said bottom surface of said recess, and said mounting device being operative to urge said neck against said at least one side surface of said recess to provide a secure mounting of said neck to said body;

at least one spring member operatively arranged to provide a biasing force acting on said neck and said body to urge said neck towards said first position; and an adjustment member mounted on one of said neck and said body and engaging the other of said neck and said body, said adjustment member being arranged to act against said biasing force and being movable so as to adjust the position of said neck between said first and second positions to thereby adjust the position of said strings relative to said neck.

23. The stringed musical instrument of claim 22, wherein said adjustment member is mounted in said body and has an end passing through said bottom surface of said recess and wherein said neck includes a bearing surface engagable by said end of said adjustment member.

24. The stringed musical instrument of claim 23, wherein said bearing surface is oriented at an acute angle relative to said bottom mounting surface of said neck, whereupon urging of said adjustment member against said bearing surface forces said neck against said at least one side surface of said recess.

25. The stringed musical instrument of claim 24, wherein said angled bearing surface is oriented so that urging of said adjustment member against said bearing surface forces said neck in a direction parallel to said longitudinal axis of said neck.

26. The stringed musical instrument of claim 22, further including a bridge on said instrument body and a nut on said neck, wherein said plurality of strings are attached to said body and said neck so as to extend over said bridge and said nut, the distance between said bridge and said nut defining the harmonic length of said strings; and wherein said mounting device includes an intonation adjustment mechanism for adjusting the distance between said bridge and said nut to thereby adjust the intonation of said instrument.

27. The stringed musical instrument of claim 26, wherein said intonation adjustment mechanism includes a longitudinal position control device having a bearing portion mounted in said body so as to move said bearing portion in a longitudinal direction substantially parallel to the direction that said strings extend; and a bearing member provided in said neck and engagable by said bearing portion of said longitudinal position control device, whereby adjustment of the position of said bearing portion relative to said body in turn adjusts the position of said neck relative to said body to adjust the intonation of said instrument.

28. The stringed musical instrument of claim 27, wherein said longitudinal position control device comprises a rocker arm mounted to pivot about an axis extending in a direction transverse to said longitudinal direction that said strings extend, and a control member; wherein said rocker arm has a first end which includes said bearing portion for engaging said bearing member in said neck and a second end; and wherein said control member is mounted in said body and has an end engagable with said second end of said rocker arm to pivot said rocker arm to move said bearing portion against said bearing member.

29. The stringed musical instrument of claim 28, wherein said control member comprises a threaded bolt threadably mounted in said body and engagable with said second end of said rocker arm.

30. The stringed musical instrument of claim 29, further including a mounting plate secured to said body in said recess and having a slot therein for mounting said rocker arm in a manner so that said rocker arm pivots about an axis extending transversely through said slot.

31. The stringed musical instrument of claim 29, wherein said first end of said rocker arm has an angled surface arranged at an acute angle to said longitudinal direction that said strings extend, and wherein said bearing member in said neck has an complimentary angled surface angled to match said angled surface on said rocker arm and arranged so that pivoting of said rocker arm causes said neck to be urged against said side of said recess.

32. The stringed musical instrument of claim 27, at least a part of said longitudinal position control device is threadably mounted in said body, and wherein rotation of said part of said longitudinal position control device causes movement of said bearing portion along said longitudinal direction substantially parallel to the direction said strings extend.

33. The stringed musical instrument of claim 32, wherein said mounting device further includes a housing mounted in said recess and having a longitudinally extending bore aligned with said longitudinal direction that said strings extend; wherein said longitudinal position control device comprises a push rod mounted for longitudinal sliding movement in said bore of said housing and a threaded control member threadably mounted in said housing, said push rod having said bearing portion at a first end thereof which is engagable with said bearing member in said neck, and having a second opposite end; and said threaded control member is operative to move said push rod within said longitudinally extending bore of said housing in response to rotation of said threaded control member.

34. The stringed musical instrument of claim 33, wherein said threaded control member is threadably mounted within said housing in alignment with said bore, and engagable with said second end of said push rod to cause said push rod to move longitudinally in response to rotational movement of said control member.

35. The stringed musical instrument of claim 33, wherein said first end of said push rod includes an angled surface arranged at an acute angle to said longitudinal direction that said strings extend, and wherein said bearing member in said neck includes a complimentary angled surface angled to match said angled surface on said push rod and arranged so that longitudinal movement of said push rod causes said neck to be urged against said at least one side surface of said recess.

36. The stringed musical instrument of claim 33, further including a push-block for engaging said second end of said push rod, said push-block including a threaded bore therethrough, and wherein said threaded control member includes a threaded bolt engagable in said threaded bore of said push-block and carried by said housing, said push-block and said threaded bolt being operative so that rotation of said threaded bolt causes said push-block to move longitudinally to move said push rod.

37. The stringed musical instrument of claim 22, wherein said adjustment member is mounted on said neck, and wherein said body includes a bearing surface provided in said recess and arranged to be contacted by said adjustment member.

38. The stringed musical instrument of claim 37, wherein said adjustment member is threadably mounted on said neck and is rotatable to adjust the amount that the end of said adjustment member extends from said bottom mounting surface of said neck.

39. The stringed musical instrument of claim 38, wherein said neck includes a fingerboard having frets on the surface thereof below said strings, and wherein said fingerboard includes an opening therein to provide access through the surface of said fingerboard to rotate said adjustment member.

40. The stringed musical instrument of claim 22, wherein said adjustment member is mounted in said body and is accessible from the bottom of said body.

41. The stringed musical instrument of claim 22, wherein said instrument body comprises an acoustic guitar body.

42. The stringed musical instrument of claim 22, wherein said instrument body comprises a solid electric guitar body.

43. The stringed musical instrument of claim 22, wherein said strings exert a tension on said neck to cause said neck to pivot in a direction toward said first position.

44. The stringed musical instrument of claim 22, wherein adjustment of the position of said neck between said first and second positions is accomplished by moving said adjustment member without adjusting said mounting device.

45. A stringed musical instrument comprising:

an instrument body having a fulcrum;

a neck extending outwardly from said instrument body in a longitudinal direction and arranged so as to be pivotable about said fulcrum on said body;

a plurality of strings attached to said body and said neck;

at least one holding member for securing said neck to said instrument body, said holding member operatively engaging said neck and said body and arranged in a manner so as to permit said neck to pivot about said fulcrum relative to said instrument body, said at least one holding member comprising a bolt having a shaft and a head, said shaft of said bolt being arranged to extend through one of said neck and said body and to engage the other of said neck and said body, and said bolt being arranged at an inclined angle relative to said longitudinal direction that said neck extends;

at least one spring member operatively arranged to provide a biasing force acting on said neck and said instrument body to urge said neck to pivot toward a first direction, said at least one spring member being arranged about said shaft of said bolt and positioned between said head of said bolt and said one of said neck and said body so that said biasing force of said at least one spring member includes a force component along said longitudinal direction that said neck extends; and a movable adjustment member operatively engaging said neck and said body and arranged in a manner so as to act against said biasing force of said at least one spring member, said adjustment member being movable so as to adjust the angular position of said neck relative to said instrument body to thereby adjust the position of said strings relative to said neck.

46. The stringed musical instrument of claim 45, wherein said at least one spring member comprises at least one belleville spring washer arranged between said head of said bolt and said one of said neck and said body.

47. The stringed musical instrument of claim 46, further including a plurality of said belleville spring washers arranged between said head of said bolt and said one of said neck and said body.

48. The stringed musical instrument of claim 45, wherein said body includes a recess having a front edge, and wherein said fulcrum is located along said front edge of said recess.

49. The stringed musical instrument of claim 48, wherein said adjustment member is threadably mounted on said neck and is rotatable to adjust the amount that the end of said adjustment member extends from the bottom surface of said neck.

50. The stringed musical instrument of claim 49, wherein said neck includes a fingerboard having frets on the surface thereof below said strings, and wherein said fingerboard includes an opening therein to provide access through the surface of said fingerboard to rotate said adjustment member.

51. The stringed musical instrument of claim 45, wherein said adjustment member is mounted in said body and is accessible from the bottom of said body.

52. The stringed musical instrument of claim 45, wherein said adjustment member is mounted on one of said neck and said body at a predetermined distance from said fulcrum, and wherein said at least one holding member is arranged so as to be located at a distance from said fulcrum which is less than said predetermined distance.

53. The stringed musical instrument of claim 45, wherein there are a plurality of said holding members, each of which has at least one of said spring members operatively associated therewith.

54. A string musical instrument comprising:

an instrument body, said body including a recess having a front edge and at least one side surface which extends substantially perpendicular to said front edge, and said body further including a fulcrum located along said front edge of said recess;

a neck having a longitudinal axis and an end received within said recess of said body, said neck extending outwardly from said instrument body and arranged so as to be pivotable about said fulcrum on said body, said longitudinal axis of said neck extending substantially parallel to said at least one side surface of said recess;

a plurality of strings attached to said body and said neck;

a mounting device operative to urge said neck against said at least one side surface of said recess;

at least one holding member for securing said neck to said instrument body, said holding member operatively engaging in said neck and said body and arranged in a manner so as to permit said neck to pivot about said fulcrum relative to said instrument body;

at least one spring member operatively arranged to provide a biasing force acting on said neck and said instrument body to urge said neck to pivot toward a first direction; and an adjustment member movably mounted on one of said neck and said instrument body and engaging the other of said neck and said instrument body, said adjustment member being arranged in a manner so as to act against said biasing force and being movable so as to adjust the angular position of said neck relative to said instrument body to thereby adjust the position of said strings relative to said neck.

55. The stringed musical instrument of claim 54, wherein said adjustment member is mounted in said body and has an end passing through the bottom surface of said recess and wherein said mounting device includes a bearing surface in said neck engagable by said end of said adjustment member and oriented in a manner so as to force said neck against said at least one side surface of said recess.

56. The stringed musical instrument of claim 54, further including a bridge on said instrument body and a nut on said neck; wherein said plurality of strings are attached to said body and said neck so as to extend over said bridge and said nut, the distance between said bridge and said nut defining the harmonic length of said strings; and further including an intonation adjustment mechanism for adjusting the distance between said bridge and said nut to thereby adjust the intonation of said instrument.

57. The stringed musical instrument of claim 56, wherein said intonation adjustment mechanism includes a longitudinal position control device having a bearing portion mounted in said body so as to move said bearing portion in a longitudinal direction substantially parallel to said longitudinal axis of said neck, and a bearing member provided in said neck and engagable by said bearing portion of said longitudinal position control device, whereby adjustment of the position of said bearing portion relative to said body in turn adjusts the position of said neck relative to said body to adjust the intonation of said instrument.

58. The stringed musical instrument of claim 57, wherein at least part of said longitudinal position control device is threadably mounted in said body, and wherein rotation of said part of said longitudinal position control device causes movement of said bearing portion along said longitudinal axis of said neck.

59. The stringed musical instrument of claim 58, wherein said intonation adjustment mechanism further includes a housing mounted in said recess and having a longitudinally extending bore aligned with said longitudinal axis of said neck; wherein said longitudinal position control device comprises a push rod mounted for longitudinal sliding movement in said bore of said housing and a threaded control member threadably mounted in said housing, said push rod having said bearing portion at a first end thereof which is engagable with said bearing member in said neck, and having a second opposite end; and wherein said threaded control member is operative to move said push rod within said longitudinally extending bore of said housing in response to rotation of said threaded control member.

60. The stringed musical instrument of claim 59, wherein said first end of said push rod includes an angled surface arranged at an acute angle to said longitudinal axis of said neck, and wherein said bearing member in said neck includes a complimentary angled surface angled to match said angled surface on said push rod and arranged so that longitudinal movement of said push rod causes said neck to be urged against said at least one side surface of said recess.

61. The stringed musical instrument of claim 59, further including a push-block for engaging said second end of said push rod, said push-block including a threaded bore therethrough, and wherein said threaded control member includes a threaded bolt engagable in said threaded bore of said push-block and carried by said housing, said push-block and said threaded bolt being operative so that rotation of said threaded bolt causes said push-block to move longitudinally to move said push rod.

62. The stringed musical instrument of claim 57, wherein said longitudinal position control device comprises a rocker arm mounted to pivot about an axis extending in a direction transverse to said longitudinal axis of said neck, and a control member; wherein said rocker arm has a first end which includes said bearing portion for engaging said bearing member in said neck and a second end; and wherein said control member is mounted in said body and has an end engagable with said second end of said rocker arm to pivot said rocker arm to move said bearing portion against said bearing member.

63. The stringed musical instrument of claim 62, wherein said first end of said rocker arm has an angled surface arranged at an acute angle to said longitudinal axis of said neck, and wherein said bearing member in said neck has an complimentary angled surface angled to match said angled surface on said rocker arm and arranged so that pivoting of said rocker arm causes said neck to be urged against said side of said recess.

64. The stringed musical instrument of claim 54, wherein said adjustment member is mounted on one of said neck and said body at a predetermined distance from said fulcrum, and wherein said at least one holding member is arranged so as to be located at a distance from said fulcrum which is less than said predetermined distance.

65. The stringed musical instrument of claim 54, wherein there are a plurality of said holding members, each of which has at least one of said spring members operatively associated therewith.

66. A string musical instrument comprising:

an instrument body;

a neck arranged to extent in a longitudinal direction outwardly from said instrument body;

a plurality of strings attached to said body and said neck;

at least one bolt member operatively engaging said neck and said body for securing said neck to said instrument body, said bolt member being arranged at an inclined angle relative to said longitudinal direction that said neck extends and arranged in a manner so as to permit said neck to pivot relative to said instrument body to adjust the position of said strings relative to said neck;

at least one spring member operatively arranged between said bolt member arranged at an inclined angle and one of said neck and said body to provide a biasing force acting to urge said neck to pivot in a first direction relative to said instrument body, said biasing force including a force component along said longitudinal direction that said neck extends; and an adjustment member operatively arranged with respect to said neck and said instrument body so as to oppose said biasing force of said spring member and provide a stop for the pivotal movement of said neck relative to said instrument body, said adjustment member being movable so as to adjust the angular position of said neck relative to said body to thereby adjust the position of said strings relative to said neck.

67. The stringed musical instrument of claim 66, wherein said bolt member has a shaft and a head, said shaft of said bolt member being arranged to extend through said one of said neck and said body and to engage the other of said neck and said body, and wherein said at least one spring member is arranged about said shaft of said bolt member and positioned between said head of said bolt member and said one of said neck and said body to urge said neck to pivot towards said first direction.

68. The stringed musical instrument of claim 67, wherein said at least one spring member comprises at least one belleville spring washer arranged between said head of said bolt member and said one of said neck and said body.

69. The stringed musical instrument of claim 68, further including a plurality of said belleville spring washers arranged between said head of said bolt member and said one of said neck and said body.

70. The stringed musical instrument of claim 66, wherein said body includes recess having a front edge, and wherein said neck is pivotable along said front edge of said recess.

71. The stringed musical instrument of claim 66, wherein there are two bolt members for securing said neck to said body.

72. The stringed musical instrument of claim 66, wherein said adjustment member is threadably mounted on said neck and is rotatable to adjust the amount that the end of said adjustment member extends from the bottom of said neck.

73. The stringed musical instrument of claim 72, wherein said neck includes a fingerboard having frets on the surface thereof below said strings, and wherein said fingerboard includes an opening therein to provide access through the surface of said fingerboard to rotate said adjustment member.

74. The stringed musical instrument of claim 66, wherein said adjustment member is mounted in said body and is accessible from the bottom of said body.

75. A stringed musical instrument comprising:

an instrument body, said body including a recess having a front edge and at least one side surface which extends in a longitudinal direction;

a neck arranged within said recess of said body and extending outwardly from said instrument body in a longitudinal direction substantially parallel to said longitudinal direction of said recess, said neck being pivotal along said front edge of said recess;

a mounting device operative to urge said neck against said at least one side surface of said recess;

a plurality of strings attached to said body and said neck;

at least one bolt member for securing said neck to said instrument body, said bolt member operatively engaging said neck and said body and arranged in a manner so as to permit said neck to pivot along said front edge of said recess to adjust the position of said strings relative to said neck;

at least one spring member operatively arranged between said bolt and one of said neck and said body to provide a biasing force acting to urge said neck to pivot in a first direction about said front edge of said recess of said instrument body; and an adjustment member operatively arranged with respect to said neck and said instrument body so as to oppose said biasing force of said spring member and provide a stop for the pivotal movement of said neck relative to said instrument body, said adjustment member being movable so as to adjust the angular position of said neck relative to said instrument body to thereby adjust the position of said strings relative to said neck.

76. The stringed musical instrument of claim 75, wherein said recess in said body includes a bottom surface, wherein said adjustment member is mounted in said body and has an end passing through said bottom surface of said recess and wherein said mounting device includes a bearing surface in said neck engagable by said end of said adjustment member and oriented in a manner so as to force said neck against said at least one side of said recess.

77. The stringed musical instrument of claim 70, further including a bridge on said instrument body and a nut on said neck; wherein said plurality of strings are attached to said body and said neck so as to extend over said bridge and said nut, the distance between said bridge and said nut defining the harmonic length of said strings; and further including an intonation adjustment mechanism for adjusting the distance between said bridge and said nut to thereby adjust the intonation of said instrument.

78. The stringed musical instrument of claim 77, wherein said intonation adjustment mechanism is operative to urge said neck against said at least one side surface of said recess to provide a secure mounting of said neck to said body.

79. The stringed musical instrument of claim 77, wherein said intonation adjustment mechanism includes a longitudinal position control device having a bearing portion mounted in said body so as to move said bearing portion in a longitudinal direction substantially parallel to the longitudinal direction that said neck extends, and a bearing member provided in said neck and engagable by said bearing portion of said longitudinal position control device, whereby adjustment of the position of said bearing portion relative to said body in turn adjusts the position of said neck relative to said body to adjust the intonation of said instrument.

80. The stringed musical instrument of claim 79, wherein at least a part of said longitudinal position control device is threadably mounted in said body, and wherein rotation of said part of said longitudinal position control device causes movement of said bearing portion along said longitudinal direction that said neck extends.

81. The stringed musical instrument of claim 80, wherein said intonation adjustment mechanism further includes a housing mounted in said recess and having a longitudinally extending bore aligned with said longitudinal direction that said neck extends; wherein said longitudinal position control device comprises a push rod mounted for longitudinal sliding movement in said bore of said housing and a threaded control member threadably mounted in said housing, said push rod having said bearing portion at a first end thereof which is engagable with said bearing member in said neck, and having a second opposite end; and wherein said threaded control member is operative to move said push rod within said longitudinally extending bore of said housing in response to rotation of said threaded control member.

82. The stringed musical instrument of claim 81, wherein said first end of said push rod includes an angled surface arranged at an acute angle to said longitudinal direction that said neck extends, and wherein said bearing member in said neck includes a complimentary angled surface angled to match said angled surface on said push rod and arranged so that longitudinal movement of said push rod causes said neck to be urged against said at least one side surface of said recess.

83. The stringed musical instrument of claim 81, further including a push-block for engaging said second end of said push rod, said push-block including a threaded bore therethrough, and wherein said threaded control member includes a threaded bolt engagable in said threaded bore of said push-block and carried by said housing, said push-block and said threaded bolt being operative so that rotation of said thread bolt causes said push-block to move longitudinally to move said push rod.

84. The stringed musical instrument of claim 79, wherein said longitudinal position control device comprises a rocker arm mounted to pivot about an axis extending in a direction transverse to said longitudinal direction that said neck extends, and a control member; wherein said rocker arm has a first end which includes said bearing portion for engaging said bearing member in said neck and a second end; and wherein said control member is mounted in said body and has an end engagable with said second end of said rocker arm to pivot said rocker arm to move said bearing portion against said bearing member.

85. The stringed musical instrument of claim 84, wherein said first end of said rocker arm has an angled surface arranged at an acute angle to said longitudinal direction that of said neck extends, and wherein said bearing member in said neck has an complimentary angled surface angled to match said angled surface on said rocker arm and arranged so that pivoting of said rocker arm causes said neck to be urged against said at least one side surface of said recess.

86. The stringed musical instrument of claim 75, wherein there are two bolt members for securing said neck to said body.

87. The stringed musical instrument of claim 75, wherein said adjustment member is threadably mounted on said neck and is rotatable to adjust the amount that the end of said adjustment member extends from the bottom of said neck.

88. The stringed musical instrument of claim 87, wherein said neck includes a fingerboard having frets on the surface thereof below said strings, and wherein said fingerboard includes an opening therein to provide access through the surface of said fingerboard to rotate said adjustment member.

89. The stringed musical instrument of claim 75, wherein said adjustment member is mounted in said body and is accessible from the bottom of said body.

90. A stringed musical instrument comprising:

an instrument body;

a neck extending in a longitudinal direction outwardly from said instrument body and arranged to pivot relative to said body;

a plurality of strings attached to said body and said neck;

a spring-loaded clamping device securing said neck to said body while permitting limited pivotal movement of said neck relative to said body, said spring-loaded clamping device including a bolt having a shaft and a head, said shaft of said bolt being arranged to extend through one of said neck and said body at inclined angle relative to said longitudinal direction that said neck extends and to engage the other of said neck and said body, said clamping device further including a spring arranged about said shaft of said bolt and positioned between said head of said bolt and said one of said neck and said body to provide a biasing force for urging said neck towards a neck seating position on said body, said biasing force provided by said spring including a force component along said longitudinal direction that said neck extends; and a movable adjustment member operatively engaging said neck and said body, said adjustment member being arranged to oppose said biasing force and being movable to cause said neck to pivot away from said neck seating position to adjust the angular position of said neck relative to said body to thereby adjust the position of said strings relative to said neck.

91. The stringed musical instrument of claim 90, wherein said spring comprises at least one belleville spring washer arranged between said head of said bolt and said one of said neck and said body.

92. The stringed musical instrument of claim 91, wherein said spring includes a plurality of said belleville spring washers arranged between said head of said bolt and said one of said neck and said body.

93. The stringed musical instrument of claim 90, wherein said body includes a recess having a front edge, and wherein said neck is mounted so as to be pivotable on said front edge of said recess.

94. The stringed musical instrument of claim 90, wherein said adjustment member is mounted in said body and is accessible from the bottom of said body.

95. The stringed musical instrument of claim 90, wherein there are two spring-loaded clamping devices for securing said neck to said body.

96. A string musical instrument comprising:

an instrument body, said instrument body including a recess having a front edge and at least one side surface which extends in a longitudinal direction;

a neck having a longitudinal axis and an end received in said recess of said instrument body, said neck extending outwardly from said instrument body in a direction so that said longitudinal axis is substantially parallel to said longitudinal direction that said at least one side surface extends, and said neck being arranged to be pivotable relative to said body about said front edge of said recess;

a mounting device operatively arranged to force said neck against said at least one side surface of said recess;

a plurality of strings attached to said body and said neck;

a spring-loaded clamping device securing said neck to said body while permitting limited pivotal movement of said neck relative to said body, said clamping device including a spring to provide a biasing force for urging said neck toward a neck seating position on said body; and an adjustment member operatively engaging said neck and said body and arranged in a manner to oppose said biasing force, said adjustment member being movable so as to cause said neck to pivot away from said neck seating position to adjust the angular position of said neck relative to said body to thereby adjust the position of said strings relative to said neck.

97. The stringed musical instrument of claim 96, wherein said recess in said body has a bottom surface, wherein said adjustment member is mounted on said body and has an end passing through said bottom surface of said recess and wherein said mounting device includes a bearing surface in said neck engagable by said end of said adjustment member and oriented in a manner so as to force said neck against said at least one side surface of said recess.

98. The stringed musical instrument of claim 96, further including a bridge on said instrument body and a nut on said neck; wherein said plurality of strings are attached to said body and said neck so as to extend over said bridge and said nut, the distance between said bridge and said nut defining the harmonic length of said strings; and further including an intonation adjustment mechanism for adjusting the distance between said bridge and said nut to thereby adjust the intonation of said instrument.

99. The stringed musical instrument of claim 98, wherein said intonation adjustment mechanism is operative to urge said neck against said at least one side surface of said recess to provide a secure mounting of said neck to said body.

100. The stringed musical instrument of claim 99, wherein said intonation adjustment mechanism includes a longitudinal position control device having a bearing portion mounted in said body so as to move said bearing portion in a longitudinal direction substantially parallel to the direction that said strings extend, and a bearing member provided in said neck and engagable by said bearing portion of said longitudinal position control device, whereby adjustment of the position of said bearing portion relative to said body in turn adjusts the position of said neck relative to said body to adjust the intonation of said instrument.

101. The stringed musical instrument of claim 100, wherein at least a part of said longitudinal position control device is threadably mounted in said body, and wherein rotation of said part of said longitudinal position control device causes movement of said bearing portion along said longitudinal direction substantially parallel to the direction said strings extend.

102. The stringed musical instrument of claim 101, wherein said intonation adjustment member further includes a housing mounted in said recess and having a longitudinally extending bore aligned with said longitudinal direction substantially parallel to the direction said strings extend; wherein said longitudinal position control device comprises a push rod mounted for longitudinal sliding movement in said bore of said housing and a threaded control member threadably mounted in said housing, said push rod having said bearing portion at a first end thereof which is engagable with said bearing member in said neck, and having a second opposite end; and wherein said threaded control member is operative to move said push rod within said longitudinally extending bore of said housing in response to rotation of said threaded control member.

103. The stringed musical instrument of claim 102, wherein said first end of said push rod includes an angled surface arranged at an acute angle to said longitudinal direction that said strings extend, and wherein said bearing member in said neck includes a complimentary angled surface angled to match said angled surface on said push rod and arranged so that longitudinal movement of said push rod causes said neck to be urged against said at least one side surface of said recess.

104. The stringed musical instrument of claim 102, further including a push-block for engaging said second end of said push rod, said push-block including a threaded bore therethrough, and wherein said threaded control member includes a threaded bolt engagable in said threaded bore of said push-block and carried by said housing, said push-block and said threaded bolt being operative so that rotation of said threaded bolt causes said push-block to move longitudinally to move said push rod.

105. The stringed musical instrument of claim 100, wherein said longitudinal position control device comprises a rocker arm mounted to pivot about an axis extending in a direction transverse to said longitudinal direction that said strings extend, and a control member; wherein said rocker arm has a first end which includes said bearing portion for engaging said bearing member in said neck and a second end; and wherein said control member is mounted in said body and has an end engagable with said second end of said rocker arm to pivot said rocker arm to move said bearing portion against said bearing member.

106. The stringed musical instrument of claim 105, wherein said first end of said rocker arm has an angled surface arranged at an acute angle to said longitudinal direction that said strings extend, and wherein said bearing member in said neck has an complimentary angled surface angled to match said angled surface on said rocker arm and arranged so that pivoting of said rocker arm causes said neck to be urged against said side at least one of said recess.

107. The stringed musical instrument of claim 96, wherein said adjustment member is threadably mounted on said neck and is rotatable to adjust the amount that the end of said adjustment member extends from the bottom of said neck.

108. The stringed musical instrument of claim 107, wherein said neck includes a fingerboard having frets on the surface thereof below said strings, and wherein said fingerboard includes an opening therein to provide access through the surface of said fingerboard to rotate said adjustment member.

109. The stringed musical instrument of claim 96, wherein said adjustment member is mounted on said one of said neck and said body at a predetermined distance from said front edge of said recess, and wherein said spring-loaded clamping device is arranged so as to be located at a distance from said front edge of said recess which is less than said predetermined distance.

110. The stringed musical instrument of claim 96, wherein there are two spring-loaded clamping devices for securing said neck to said body.

* * * * *

UNITED STATES PATENT AND TRADEMARK OFFICE

CERTIFICATE OF CORRECTION

PATENT NO. : 6,265,648 B1
DATED : July 24, 2001
INVENTOR(S) : Steinberger

It is certified that error appears in the above-identified patent and that said Letters Patent is hereby corrected as shown below:

Column 30,
Line 31, "thread" should read -- threaded --.
Line 48, "an" should read -- a --.

Column 31,
Line 48, "string" should read -- stringed --.

Column 34,
Line 2, "an" should read -- a --.
Line 5, after "side" insert -- of --.

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,265,648 B1
DATED : July 24, 2001
INVENTOR(S) : Steinberger

It is certified that error appears in the above-identified patent and that said Letters Patent is hereby corrected as shown below:

Column 2,
Line 1, "are" should read -- is --.
Line 21, before "construct" cancel -- the --.

Column 4,
Line 16, "cause" should read -- causes --.

Column 5,
Line 29, before "neck" insert -- the --.

Column 10,
Line 10, after "to" insert -- , --.
Line 10, after "than" insert -- , --.

Column 11,
Line 58, "provides" should read -- provide --.

Column 12,
Line 24, "is" should read -- are --.

Column 13,
Line 26, "are" should read -- is --.

Column 17,
Line 15, "comprises" should read -- comprise --.

Column 23,
Line 65, after "27," insert -- wherein --.

Column 26,
Line 8, "string" should read -- stringed --.

Column 27,
Line 52, "an" should read -- a --.

UNITED STATES PATENT AND TRADEMARK OFFICE

CERTIFICATE OF CORRECTION

PATENT NO. : 6,265,648 B1
DATED : July 24, 2001
INVENTOR(S) : Steinberger

It is certified that error appears in the above-identified patent and that said Letters Patent is hereby corrected as shown below:

Column 28,
Line 1, "string" should read -- stringed --.
Line 3, "extent" should read -- extend --.
Line 9, after "direction" insert -- so --.
Line 10, after "and" insert -- is --.
Line 46, after "includes" insert -- a --.

Column 29,
Line 36, "70" should read -- 75 --.

Signed and Sealed this

Twenty-fifth Day of June, 2002

*Attest:*

JAMES E. ROGAN
*Director of the United States Patent and Trademark Office*

*Attesting Officer*